US007026995B2

(12) United States Patent
Sreenivas et al.

(10) Patent No.: US 7,026,995 B2
(45) **Date of Patent: *Apr. 11, 2006**

(54) DIELECTRIC MATERIALS WITH MODIFIED DIELECTRIC CONSTANTS

(75) Inventors: Ajay I. Sreenivas, Niwot, CO (US); Farzin Lalezari, Boulder, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 54 days.

This patent is subject to a terminal disclaimer.

(21) Appl. No.: 10/764,422

(22) Filed: Jan. 23, 2004

(65) Prior Publication Data

US 2004/0155820 A1 Aug. 12, 2004

Related U.S. Application Data

(62) Division of application No. 10/056,413, filed on Jan. 24, 2002, now Pat. No. 6,795,020.

(51) Int. Cl.
*H01Q 1/38* (2006.01)

(52) U.S. Cl. ..... 343/700 MS; 343/824; 343/893

(58) Field of Classification Search ..... 343/700 MS, 343/793, 795, 824, 829, 846, 853, 893, 727
See application file for complete search history.

(56) References Cited

U.S. PATENT DOCUMENTS

| | | | | |
|---|---|---|---|---|
| 3,346,865 | A * | 10/1967 | Jones, Jr. | 343/771 |
| 4,263,598 | A | 4/1981 | Bellee et al. | 343/700 |
| 4,623,894 | A | 11/1986 | Lee et al. | 343/700 |
| 4,870,426 | A | 9/1989 | Lamberty et al. | 343/727 |
| 4,929,959 | A | 5/1990 | Sorbello et al. | 343/700 |
| 5,208,603 | A | 5/1993 | Yee | 343/909 |
| 5,231,406 | A | 7/1993 | Sreenivas | 343/700 |
| 5,382,959 | A | 1/1995 | Pett et al. | 343/700 |
| 5,444,452 | A | 8/1995 | Itoh et al. | 343/700 |
| 5,453,751 | A | 9/1995 | Tsukamoto et al. | 343/700 |
| 5,471,221 | A | 11/1995 | Nalbandian et al. | 343/700 |
| 5,510,803 | A | 4/1996 | Ishizaka et al. | 343/700 |
| 5,534,877 | A | 7/1996 | Sorbello et al. | 343/700 |
| 5,561,434 | A | 10/1996 | Yamazaki | 343/700 |
| 5,838,282 | A | 11/1998 | Lalezari et al. | 343/727 |
| 5,859,616 | A | 1/1999 | Gans et al. | 343/700 |
| 5,872,545 | A | 2/1999 | Rammos | 343/770 |
| 5,923,296 | A | 7/1999 | Sanzgiri et al. | 343/700 |
| 5,955,994 | A | 9/1999 | Staker et al. | 343/700 |
| 6,054,953 | A | 4/2000 | Lindmark | 343/700 |
| 6,075,485 | A | 6/2000 | Lilly et al. | 343/700 |
| 6,114,998 | A | 9/2000 | Schefte et al. | 343/700 |
| 6,118,406 | A | 9/2000 | Josypenko | 343/700 |
| 6,121,931 | A | 9/2000 | Levi | 343/700 |
| 6,175,333 | B1 | 1/2001 | Smith et al. | 343/700 |

(Continued)

FOREIGN PATENT DOCUMENTS

DE 4021 167 A1 1/1991

(Continued)

*Primary Examiner*—Shih-Chao Chen
(74) *Attorney, Agent, or Firm*—Sheridan Ross, P.C.

(57) ABSTRACT

Dielectric materials having modified dielectric constants and methods for modifying the dielectric constant of a dielectric material are provided. Generally, the dielectric constant of a dielectric material is modified by providing relieved portions within the dielectric material. The relieved portions may comprise holes formed in the dielectric material. In connection with dielectric material that is incorporated into an antenna apparatus, the size and/or arrangement of holes or other relieved portions in the dielectric material can be determined with reference to the operating wavelengths of the antenna apparatus.

36 Claims, 18 Drawing Sheets

U.S. PATENT DOCUMENTS

| | | | | |
|---|---|---|---|---|
| 6,181,277 | B1 | 1/2001 | Kesler et al. | 343/700 |
| 6,191,740 | B1 | 2/2001 | Kates et al. | 343/700 |
| 6,208,299 | B1 | 3/2001 | Lindmark et al. | 343/700 |
| 6,483,481 | B1 | 11/2002 | Sievenpiper et al. | 343/909 |
| 6,529,166 | B1 | 3/2003 | Kanamaluru | 347/700 |
| 6,795,020 | B1 * | 9/2004 | Sreenivas et al. | 343/700 MS |
| 2003/0137456 | A1 | 7/2003 | Sreenivas et al. | 343/700 |

FOREIGN PATENT DOCUMENTS

| | | |
|---|---|---|
| EP | 0 433 255 | 1/1997 |

* cited by examiner

Fig. 1A
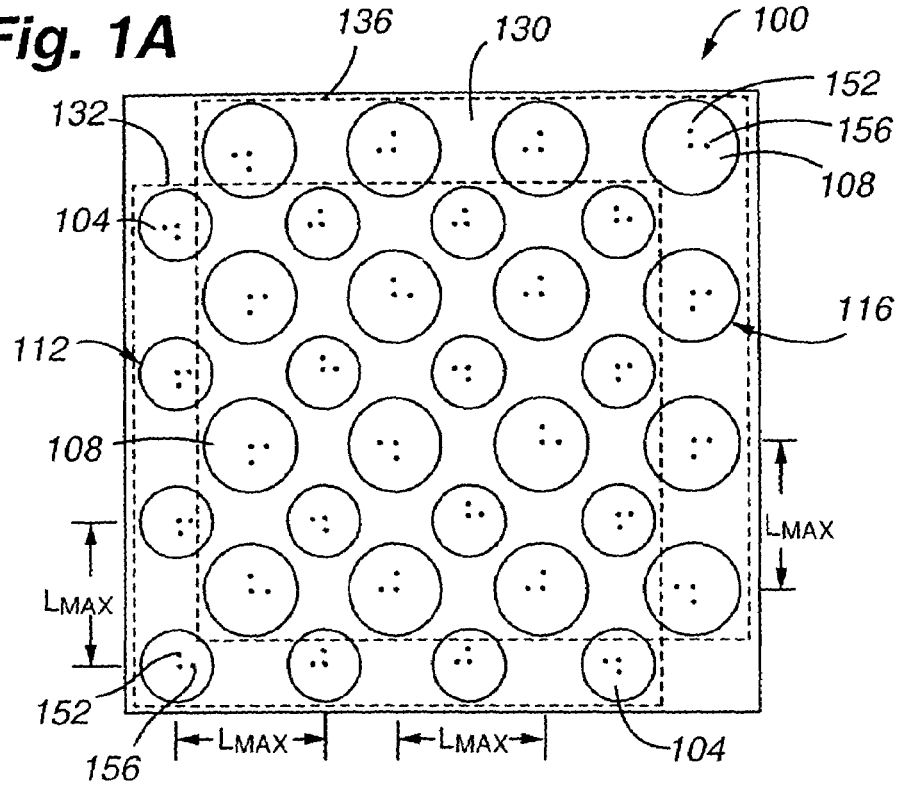
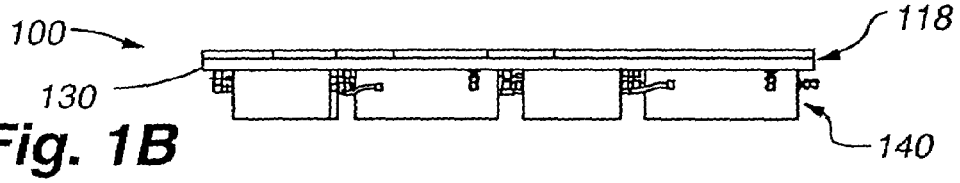
Fig. 1B
Fig. 1C
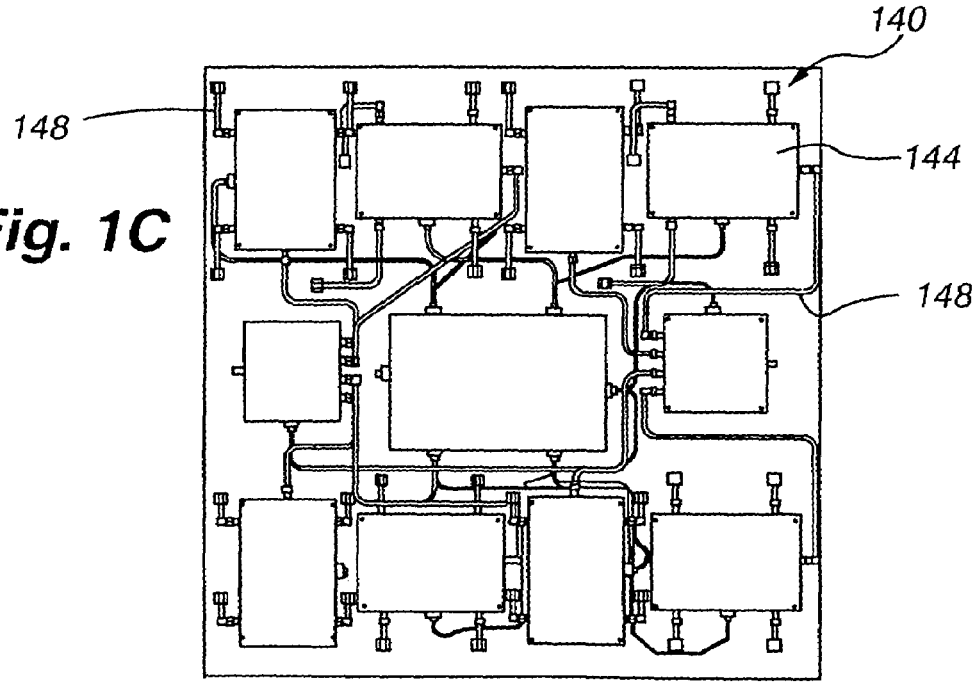

CP1383 is 1575MHz,
CP1383 is 1575MHz,

Function Values:
PHI ANGLE:90.0,
PHI ANGLE:90.0,

Max: 18.79dB at -1deg, Min:-35.13dB at -169deg
Max: -12.09dB at 89deg, Min:-34.86dB at 41deg

DIELECTRIC MATERIALS WITH MODIFIED DIELECTRIC CONSTANTS

CROSS REFERENCE TO RELATED APPLICATION

This application is a divisional application of U.S. patent application Ser. No. 10/056,413, filed Jan. 24, 2002, now U.S. Pat. No. 6,795,020, the entire disclosure of which is hereby incorporated herein by reference.

FIELD OF THE INVENTION

Dielectric materials having modified dielectric constants, and methods for modifying the dielectric constant of a dielectric material are provided. Furthermore, antenna apparatuses incorporating dielectric materials with a modified dielectric constant and methods for providing antenna components are provided.

BACKGROUND OF THE INVENTION

Antennas are used to radiate and receive radio frequency signals. The transmission and reception of radio frequency signals is useful in a broad range of activities. For instance, radio wave communication systems are desirable where communications are transmitted over large distances. In addition, radio frequency signals can be used in connection with obtaining geographic position information.

In order to provide desired gain and directional characteristics, the dimensions and geometry of an antenna are typically such that the antenna is useful only within a relatively narrow band of frequencies. It is often desirable to provide an antenna capable of operating at more than one range of frequencies. However, such broadband antennas typically have less desirable gain characteristics than antennas that are designed solely for use at a narrow band of frequencies. Therefore, in order to provide acceptable gain at a variety of frequency bands, devices have been provided with multiple antennas. Although such an approach is capable of providing high gain at multiple frequencies, the provision of multiple antennas requires relatively large amounts of physical space.

An example of a device in which relatively high levels of gain at multiple frequencies and a small antenna area are desirable are wireless telephones capable of operating in connection with different wireless communication technologies. In particular, it may be desirable to provide a wireless telephone capable of operating in connection with different wireless systems having different frequencies, when communication using a preferred system is not available. Furthermore, in wireless telephones, a typical requirement is that the telephone provide high gain, in order to allow the physical size and power consumption requirements of the telephone components to be small.

Another example of a device in which high gain characteristics at multiple frequencies and a small antenna area are desirable are global positioning system (GPS) receivers. In particular, GPS receivers using dual frequency technologies, or using differential GPS techniques, must be capable of receiving weak signals transmitted on two different carrier signals. As in the example of wireless telephones, it is generally desirable to provide GPS receivers that are physically small, and that have relatively low power consumption requirements.

Still another example of a device in which a relatively high gain at multiple frequency bands is desirable is in connection with a communications satellite or a global positioning system satellite. In such applications, it can be advantageous to provide phased array antennas capable of providing multiple operating frequencies and of directing their beam towards a particular area of the Earth. In addition, it can be advantageous to provide such capabilities in a minimal area, to avoid the need for large and complex radiator structures.

Planar microstrip antennas have been utilized in connection with various devices. However, providing multiple frequency capabilities typically requires that the area devoted to the antenna double (i.e., two separate antennas must be provided) as compared to a single frequency antenna. Alternatively, microstrip antenna elements optimized for operation at a first frequency have been positioned in a plane overlaying a plane containing microstrip antenna elements adapted for operation at a second frequency. Although such devices are capable of providing multiple frequency capabilities, they require relatively large surfaces or volumes, and are therefore disadvantageous when used in connection with portable devices. In addition, such arrangements can be expensive to manufacture, and can have undesirable interference and gain characteristics.

The amount of space required by an antenna is particularly apparent in connection with phased array antennas. Phased array antennas typically include a number of radiator elements arrayed in a plane. The elements can be provided with differentially delayed versions of a signal, to steer the beam of the antenna. The steering, or scanning, of an antenna's beam is useful in applications in which it is desirable to point the beam of the antenna in a particular direction, such as where a radio communications link is established between two points, or where information regarding the direction of a target object is desired. The elements comprising phased array antennas usually must be spread over a relatively large area. Furthermore, in order to provide phased array antennas capable of operating at two different frequency bands, two separate arrays must be provided. Therefore, a conventional phased array antenna for operation at two different frequency bands can require twice the area of a single frequency band array antenna, and the phase centers of the separate arrays are not co-located. Alternatively, arrays can be stacked one on top of the other, however this approach results in antennas that are difficult to design such that they operate efficiently, and are expensive to manufacture. In addition, prior attempts at providing antenna arrays capable of operating at two distinct frequency bands have resulted in poor performance, including the creation of grating lobes, large amounts of coupling, large losses, and have required relatively large areas.

Therefore, there is a need for an antenna capable of operating at multiple frequencies that is relatively compact and that occupies a relatively small surface area. In addition, there is a need for such an antenna capable of providing a beam having high gain at multiple frequencies that can be scanned. Moreover, there is a need for an antenna capable of providing high gain at multiple frequencies that can be packaged within a relatively small area or volume, and that minimizes coupling and losses due to the close proximity of the antenna elements. Furthermore, it would be advantageous to provide an antenna capable of operating at multiple frequency bands and having co-located phase centers. In addition, such an antenna should be reliable and inexpensive to manufacture.

SUMMARY OF THE INVENTION

In accordance with the present invention, a dual band, coplanar, microstrip, interlaced array antenna is provided. The antenna includes a first plurality of antenna radiator elements forming a first array for operation at a first center frequency, interlaced with a second plurality of antenna radiator elements forming a second array for operation at a second center frequency. The antenna is capable of providing high gain in both the first and second center frequencies. In addition, the antenna may be designed to provide a desired scan range for each of the operating frequency bands.

In accordance with an embodiment of the present invention, the first and second pluralities of antenna radiator elements are located within a common plane. In addition, radiator elements adapted for use in connection with the first operating frequency band may be interlaced with radiator elements adapted for operation at the second operating frequency band. Accordingly, the footprint or area of the first antenna array may substantially overlap with the footprint or area of the second antenna array. Therefore, a dual band array antenna may be provided within an area about equal to the area of a single band array antenna having comparable performance at one of the operating frequencies of the dual band antenna.

In accordance with an embodiment of the present invention, a dual band, coplanar, microstrip array antenna is formed using metallic radiator elements. Radiator elements for operation at a first operating frequency band of the antenna are provided in a first size, and overlay a substrate having a first dielectric constant. Radiator elements for operation in connection with the second operating frequency band of the antenna are provided in a second size, and are positioned over a substrate having a second dielectric constant. The radiator elements may be arranged in separate rectangular lattice formations to form first and second arrays. The elements of the first and second arrays are interlaced so that the resulting dual band antenna occupies less area than the total area of the first and second arrays would occupy were their respective radiator elements not interlaced.

In accordance with still another embodiment of the present invention, a method for providing a dual frequency band antenna apparatus is provided. According to such a method, first and second center frequencies are selected. In addition, a scan range for the first center frequency and a scan range for the second center frequency are selected. From the wavelength corresponding to the first center frequency and the scan range for that first center frequency a lattice spacing for a first plurality of radiator elements is determined. The lattice spacing is the center to center spacing between radiator elements within an array of elements. Similarly, a lattice spacing for a second plurality of radiator elements is determined from the wavelength corresponding to the second center frequency and the scan range for the second center frequency. The maximum lattice spacing is the smaller of the lattice spacings for the first or second plurality of radiator elements. Where the scan range of one or both arrays is a first value in a first dimension and a second value in a second dimension, lattice spacing calculations may be made for each dimension.

A dielectric constant for a first substrate as a function of the wavelength of the first center frequency and the maximum lattice spacing may then be selected. The dielectric constant for the first substrate should have a value that is no less than 1.0. The dielectric constant for a second substrate may then be calculated as a function of the first substrate dielectric constant, the first center frequency, and the second center frequency. Next, an effective size of the radiator elements in the first plurality of radiator elements and of the radiator elements in the second plurality of radiator elements can be calculated as a function of the wavelength of the operative center frequency and the corresponding dielectric constant of the substrate. A physical size of the first radiator elements and of the second radiator elements can then be calculated.

In accordance with a further embodiment of the present invention, a first plurality of radiator elements are formed on dielectric material having a dielectric constant equal to the first dielectric constant calculated according to the method. In addition, the second plurality of radiator elements is formed on dielectric material having a dielectric constant equal to the second dielectric constant. A first array may then be formed from the first plurality of radiator elements. The radiator elements of the first array are arranged about a rectangular lattice and have a center to center spacing equal to the calculated maximum lattice spacing. Similarly, a second array is formed from the second plurality of radiator elements. The radiator elements of the second array are arranged about a rectangular lattice and have a center to center spacing equal to the calculated maximum lattice spacing. The first array is then interlaced with the second array. Accordingly, a dual band antenna occupying a reduced surface area may be provided.

In accordance with another embodiment of the present invention, a method for modifying the effective dielectric constant of a material is provided. According to the method, portions of a material may be relieved, for example by forming holes in the material, in an area in which a modified (i.e. reduced) dielectric constant is desired. According to an embodiment of the present invention, a modified effective dielectric constant is obtained by forming holes in a triangular lattice pattern in an area of a dielectric material in which a reduced effective dielectric constant is desired. In accordance with yet another embodiment of the present invention, a material having a modified effective dielectric constant is provided.

Based on the foregoing summary, a number of salient features of the present invention are readily discerned. A dual band antenna that allows for the scanning of the two center frequencies is provided. The antenna further allows for the provision of a dual band scanning antenna apparatus occupying a reduced surface area. The antenna allows support of both center frequencies with minimal or no grating lobes and minimal coupling. The antenna may be formed from two, co-planar, interlaced arrays. Furthermore, the present invention allows the provision of a dual band scanning antenna that occupies a reduced surface area, that provides a desired scan range of the operative frequencies and in which a desired amount of directivity is provided.

In addition, a material having a modified effective dielectric constant, and a method for modifying the effective dielectric constant of a material, are provided.

Additional advantages of the present invention will become readily apparent from the following discussion, particularly when taken together with the accompanying drawings.

BRIEF DESCRIPTION OF THE DRAWINGS

FIG. 1A is a plan view of a dual band array antenna in accordance with an embodiment of the present invention;

FIG. 1B is a side elevation of the antenna of FIG. 1A;

FIG. 1C is a plan view of the back side of the antenna of FIG. 1A;

DETAILED DESCRIPTION

Figure 2:
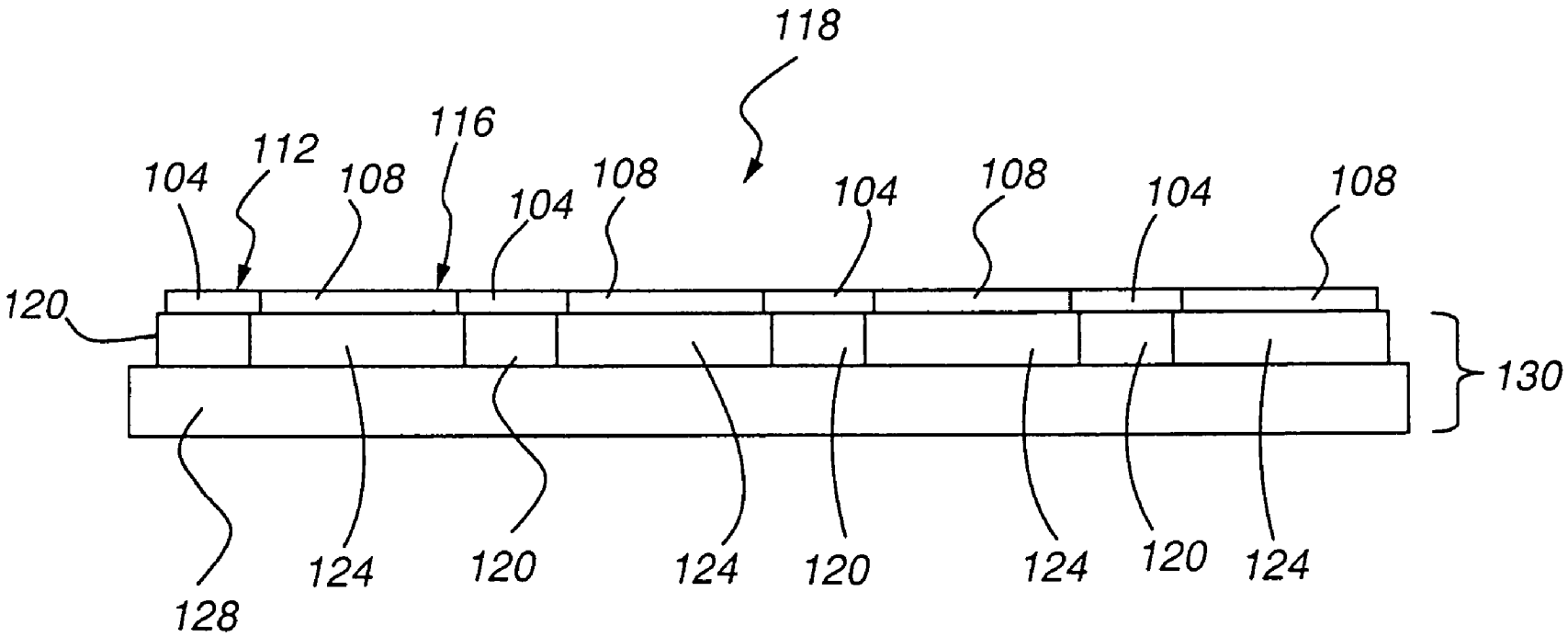
FIG. 2 is a side elevation of the radiator assembly of the antenna of FIGS. 1A–1C.

In accordance with the present invention, dual band array antennas and methods for providing dual band antennas are disclosed.

With reference now to FIG. 1A, a dual band array antenna 100 in accordance with an embodiment of the present invention is illustrated in plan view. In general, the antenna 100 comprises a first plurality of radiator elements 104 for operation at a first operating or center frequency $f_1$, and a second plurality of radiator elements 108 for operation at a second operating or center frequency $f_2$. The first plurality of radiator elements 104 are arranged about a rectangular lattice, with a center to center spacing equal to $L_{max}$, which is determined as will be described in greater detail below. Similarly, the second plurality of radiator elements 108 are arranged to form a second array arranged about a rectangular lattice in which the center to center spacing of the elements is also equal to $L_{max}$. The radiator elements 104, 108 may be formed on a substrate assembly 130, as will be explained in greater detail below.

With reference now to FIG. 1B, the antenna system 100 of FIG. 1A is shown in a side elevation. As shown in FIG. 1B, the antenna system 100 may be considered as a radiator assembly 118, generally comprising the substrate assembly 130 and the radiator elements 104, 108, and a feed network 140.

The feed network 140 is best illustrated in FIG. 1C, which depicts a side of the antenna system 100 opposite the side illustrated in FIG. 1A. In general, the feed network 140 comprises signal amplifiers and phase shifters, housed in enclosures 144, and signal feed lines 148. Certain of the feed lines 148 interconnect the radiator elements 104, 108 to the amplifiers housed in the enclosures 144. By positioning the amplifiers and phase shifters in close proximity to the radiator elements 104, 108, the antenna system 100 illustrated in FIGS. 1A–1C avoids the losses incurred from power divider circuits. Accordingly, the antenna system 100 illustrated in FIGS. 1A–1C may be understood to be an active antenna system.

In addition, it should be appreciated that the feed lines 148 for passing signals between the radiator elements 104, 108 and corresponding amplifiers and phase shifters within the enclosures 144 may be interconnected to the radiator elements 104, 108 at one or a number of points. For example, as shown in FIG. 1A, feed lines 148 may be interconnected to radiator elements 104, 108 at two separate feed points 152. In general, where the antenna system 100 is circularly polarized, the signal is provided from a single amplifier over a feed line 148. A portion of that signal is then passed through a hybrid, such that the phase of the signal provided at a first feed point 152 is 90 degrees from the phase of the signal provided at the second feed point 156. Furthermore, as can be appreciated by one of ordinary skill in the art, hybrids providing additional phase shifts may be used in connection with a greater number of feed points. For instance, when four feed points are provided on a radiator element, spaced 90 degrees apart about the element, hybrids capable of phase shifting the signal by 90, 180, and 270 degrees with respect to the signal provided to a first of the feed points may be used.

In accordance with yet another embodiment of the present invention, a dedicated amplifier is provided for supplying a properly phased signal to each feed point associated with a radiator element 104 or 108. According to such an embodiment, an antenna system 100, such as the one illustrated in FIGS. 1A–1C would include two amplifiers for each radiator element 104, 108. Similarly, an antenna system utilizing more (e.g., four) feed points would utilize a greater number (e.g., four) amplifiers in connection with each radiator element 104, 108. According to such an embodiment, the use of hybrids interposed between an amplifier and the radiator elements 104, 108 can be avoided. Such embodiments allow a large number of relatively small amplifiers to be used, and can increase the efficiency of the antenna system 100 as compared to systems in which hybrid circuits and/or power divider circuits are interposed between the amplifiers and the radiator elements 104, 108.

As can be appreciated by one of ordinary skill in the art, the number of feed points that may be used in connection with a particular radiator element 104, 108 depends, at least in part, on the geometry of the radiator element 104, 108. For instance, in connection with a circular radiator element 104, 108, one, two or four feed points are typically used. Similarly, in connection with a square radiator element, one, two or four feed points may typically be used. Radiator elements having dipole configurations typically may use one or two feed points. The increased efficiency provided by the use of one or more amplifiers for each feed point is particularly advantageous in connection with applications involving the transmission of high-powered signals, or the reception of relatively small signals.

With reference now to FIG. 2, the radiator assembly 118 of FIGS. 1A–1C is shown in detail in a side elevation. From FIG. 2 it can be appreciated that the radiator elements 104 of the first array 112 are formed or mounted on a first dielectric material or substrate 120. The first dielectric material 120 has a first dielectric constant ($e_{r1}$), calculated as will be explained in detail below. Similarly, the radiator elements 108 of the second array 116 are formed or mounted on a second dielectric material or substrate 124 having a second dielectric constant ($e_{r2}$), calculated as will also be explained in detail below. The first 120 and second 124 dielectric materials may in turn be formed or attached to a conductive ground plane 128. The first dielectric material 120, the second dielectric material 124 and the ground plane 128 comprise the substrate assembly 130. Furthermore, the radiator elements 104, 108 may be substantially coplanar in that they are interconnected to a common substrate assembly 130. According to an embodiment of the present invention, the first plurality of radiator elements 104 may be situated in a first plane that is coplanar or substantially coplanar with a second plane in which the second plurality of radiator elements 108 are situated. For instance, the first dielectric material 120 associated with the first plurality of radiator elements 104 may be a first thickness, and the second dielectric material 124 associated with the second plurality of radiator elements 108 may be a second thickness, placing the first 104 and second 108 radiator elements in different planes. As a further example, the first and second planes may be within a distance equal to a thickness of at least one of the first 104 or second 108 radiator elements.

In accordance with an embodiment of the present invention, the radiator elements 104 and 108 comprise electrically conductive microstrip patches. The dielectric substrates 120 and 124 may be formed from any dielectric material having the required dielectric constant. For example, the second dielectric material 124 may be a DUROID material with a dielectric constant of 2.33 and the first dielectric material 120 may be a DUROID material, modified as explained below, to have a dielectric constant of 1.5. In addition, one or both of the dielectric materials 120, 124 may be found from air, in which case the radiator elements 104 and/or 108 may be held in position over the ground plane by dielectric posts. The ground plane 128 may be any electrically conductive material. For example, the ground plane 128 may be metal. In general, any substrate assembly 130 configuration that provides a backing or a substrate for the first radiator elements 104 having a first dielectric constant ($e_{r1}$) and a backing or a substrate for the second radiator elements 108 having a second dielectric constant ($e_{r2}$) may be utilized in connection with the present invention. Furthermore, it should be appreciated that the first 120 and second 124 dielectric substrates may be formed from a common piece of material (i.e. the dielectric substrates 120, 124 may be integral to one another). According to such an embodiment, the dielectric constant in areas adjacent the first plurality of radiator elements 104 may be modified as compared to the dielectric constant in areas adjacent the second plurality of radiator elements 108, or vice versa. In addition, it should be appreciated that a material may be modified to have a first dielectric constant ($e_{r1}$) value in areas adjacent the first plurality of radiator elements 104 and may be modified to have a second dielectric constant ($e_{r2}$) value in areas adjacent the second plurality of radiator elements 108. The effective dielectric constant value of a material may be modified by using composite materials, or by forming holes in a dielectric material, as will be explained in detail below.

With continued reference to FIG. 1, the antenna 100 can be seen to comprise circular radiator elements 104 and 108. In addition, it can be seen that each of the arrays 112 and 116 formed from the radiator elements 104 and 108 contains an equal number of radiator elements 104 or 108. Of course, it is not necessary that the arrays 112 and 116 have an equal number of elements. Also with reference to FIG. 1, it can be appreciated that an overall area occupied by the first array 112, denoted by dotted line 132 in FIG. 1, substantially overlaps with an overall area occupied by the second array 116, denoted by dotted line 136 in FIG. 1. This overlap is achieved by interlacing the elements 104 of the first array 112 with the elements 108 of the second array 116. Accordingly, an antenna 100 providing arrays 112 and 116 having different operating frequencies can be provided within an area that is substantially equal to an area of either the first array 112 or the second array 116 alone. Furthermore, the antenna 100 provides dual band capabilities in a relatively small surface area without the formation of undesirable grating lobes, and while providing a desired scan range and directivity.

As can be appreciated by one of ordinary skill in the art, the size of the arrays 112, 116 (i.e. the area occupied by the arrays 112, 116) is determined by the required beamwidth and the frequency of operation. In general, a narrow beam requires a larger array size and hence a larger number of elements. The converse is true for a broader beam. Also, for a given beamwidth, a physically larger array is required at a lower frequency than at a higher frequency. Furthermore, it can be appreciated that the arrays (or apertures) may be partially populated to realize the desired beamwidths at each of the operating frequencies.

Figure 3:
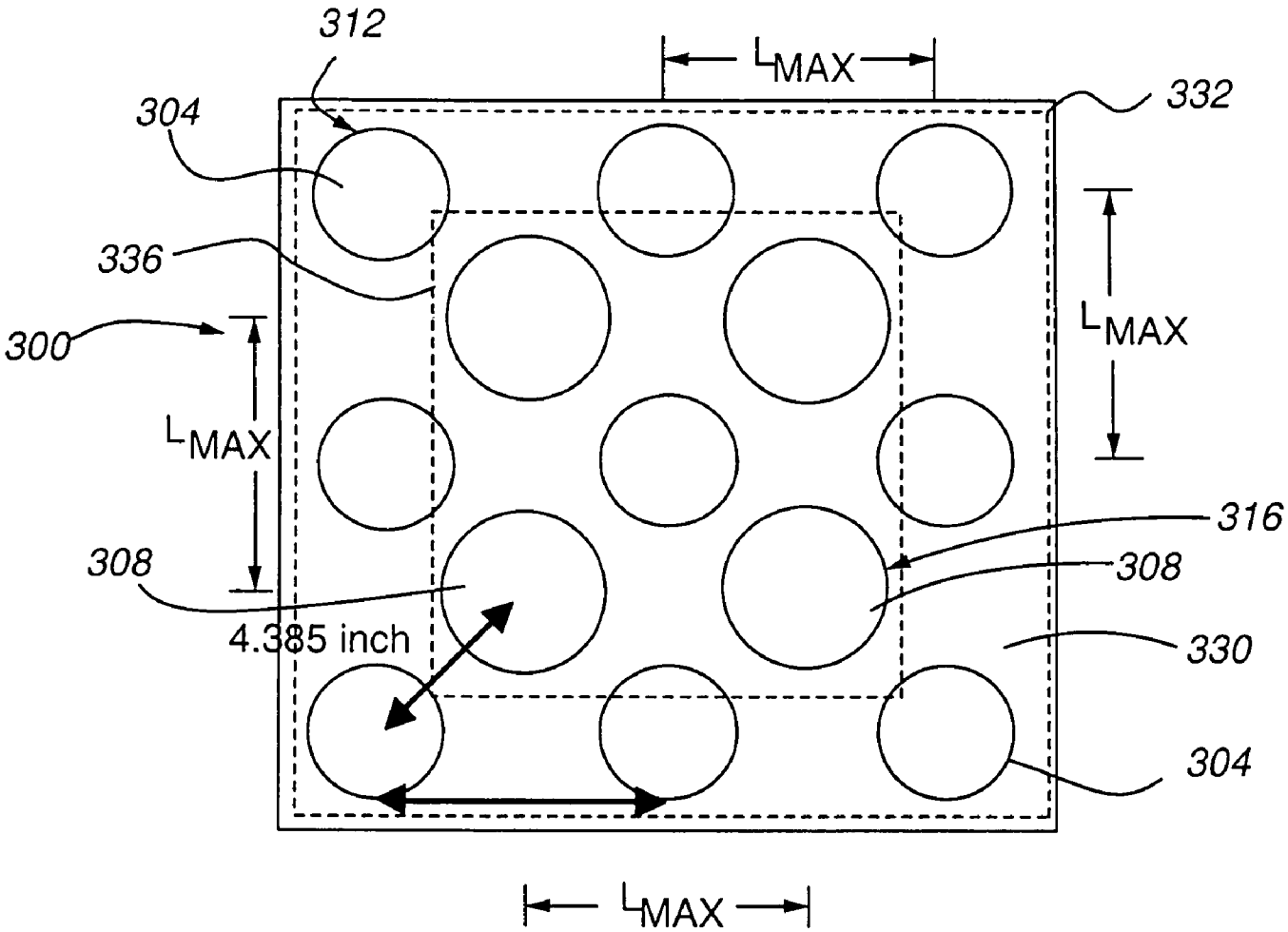
FIG. 3 is a plan view of a dual band array antenna in accordance with another embodiment of the present invention.

With reference now to FIG. 3, a dual band antenna 300 in accordance with another embodiment of the present invention is illustrated. In general, the antenna 300 includes a first plurality of radiator elements 304 for operation at a first operating or center frequency $f_1$, and a second plurality of radiator elements 308 for operation at a second operating or center frequency $f_2$. As in the antenna system 100 shown in FIG. 1, the antenna 300 of FIG. 3 comprises radiator elements 304 and 308 formed from circular patches. Also as in the antenna 100 of FIG. 1, the antenna 300 in FIG. 3 features a first array 312 formed from the first plurality of radiator elements 304, arranged about a rectangular lattice, and with a center to center spacing of the radiator elements 304 that is equal to $L_{max}$. The antenna 300 also includes a second array 316 formed from the second plurality of radiator elements 308. The second array 316 includes elements spaced along a rectangular lattice and having a center to center spacing between elements 308 equal to $L_{max}$. The first and second arrays 312, 316 may be interconnected to one another by a substrate assembly 330 that provides a first dielectric constant adjacent the first radiator elements 304, a second dielectric constant adjacent the second radiator elements 308, and a common ground plane.

The first array 312 of the antenna 300 includes nine radiator elements 304 occupying a first area, denoted by dotted line 332 in FIG. 3. The second array 316 includes four radiator elements 308 occupying a second area, denoted by dotted line 336. As can be appreciated from FIG. 3, the elements 304 of the first array are interlaced with the elements 308 of the second array 316, such that the area 336 occupied by the second array 316 substantially overlaps with the area 332 occupied by the first array 312. Furthermore, it can be appreciated that the areas 332, 336 of the first 312 and the second 316 arrays are centered about the same point.

Figure 4:
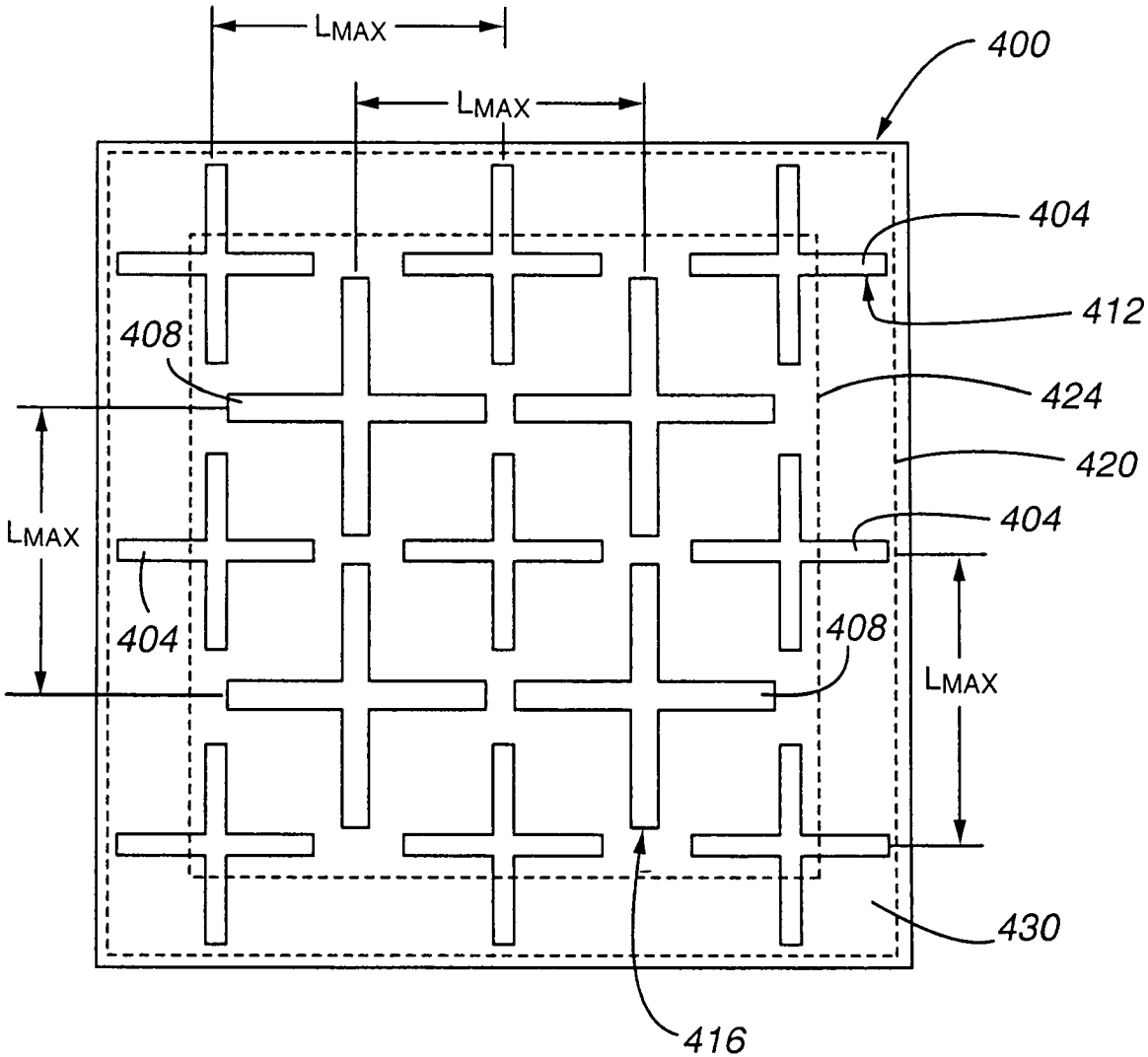
FIG. 4 is a plan view of a dual band array antenna having dipole radiator elements in accordance with an embodiment of the present invention.

In FIG. 4, a dual band antenna 400 in accordance with still another embodiment of the present invention is illustrated. In general, the antenna 400 includes a first plurality of radiator elements 404 for operation at a first operating or center frequency $f_1$, and a second plurality of radiator elements 408 for operation at a second operating or center frequency $f_2$. In the antenna 400 depicted in FIG. 4, a first array 412 is formed from the first plurality of radiator elements 404. The radiator elements 404 of the first array 412 are arranged about a rectangular lattice and have a center to center spacing equal to $L_{max}$. A second array 416 is formed from the second plurality of radiator elements 408. The radiator elements 408 of the second array 416 are arranged about a rectangular lattice, and have a center to center spacing that is also equal to $L_{max}$. The radiator elements 404, 408 in the embodiment shown in FIG. 4 have a dipole configuration. Therefore, it can be appreciated that various radiator configurations may be used in connection with the present invention.

The first array 412 of the antenna 400 includes nine radiator elements 404 occupying a first area, denoted by dotted line 420 in FIG. 4. The second array 416 includes four radiator elements 408 occupying a second area, denoted by dotted line 424. As can be appreciated from FIG. 4, the elements 404 of the first array 412 are interlaced with the elements 408 of the second array 416, such that all of the area 424 occupied by the second array 416 is included in the area 420 occupied by the first array 412. Therefore, it can be appreciated that the first 412 and second 416 arrays occupy areas 420, 424 that substantially overlap. This overlap of the first 412 and second 416 arrays substantially decreases the surface area required by an antenna having the operating characteristics of the antenna 400.

The radiator elements 404, 408 may be located in common plane, formed on a substrate assembly 430 that provides a first dielectric constant with respect to the first radiator elements 404, a second dielectric constant with respect to the second radiator elements 408, and a common ground plane. In addition to the relatively small surface area required by the dual band antenna 400, it will be noted that the areas 420, 424 occupied by the arrays 412, 416 share a common center point. Accordingly, the arrays 412, 416 of the antenna 400 provide co-located phase centers.

Figure 5:
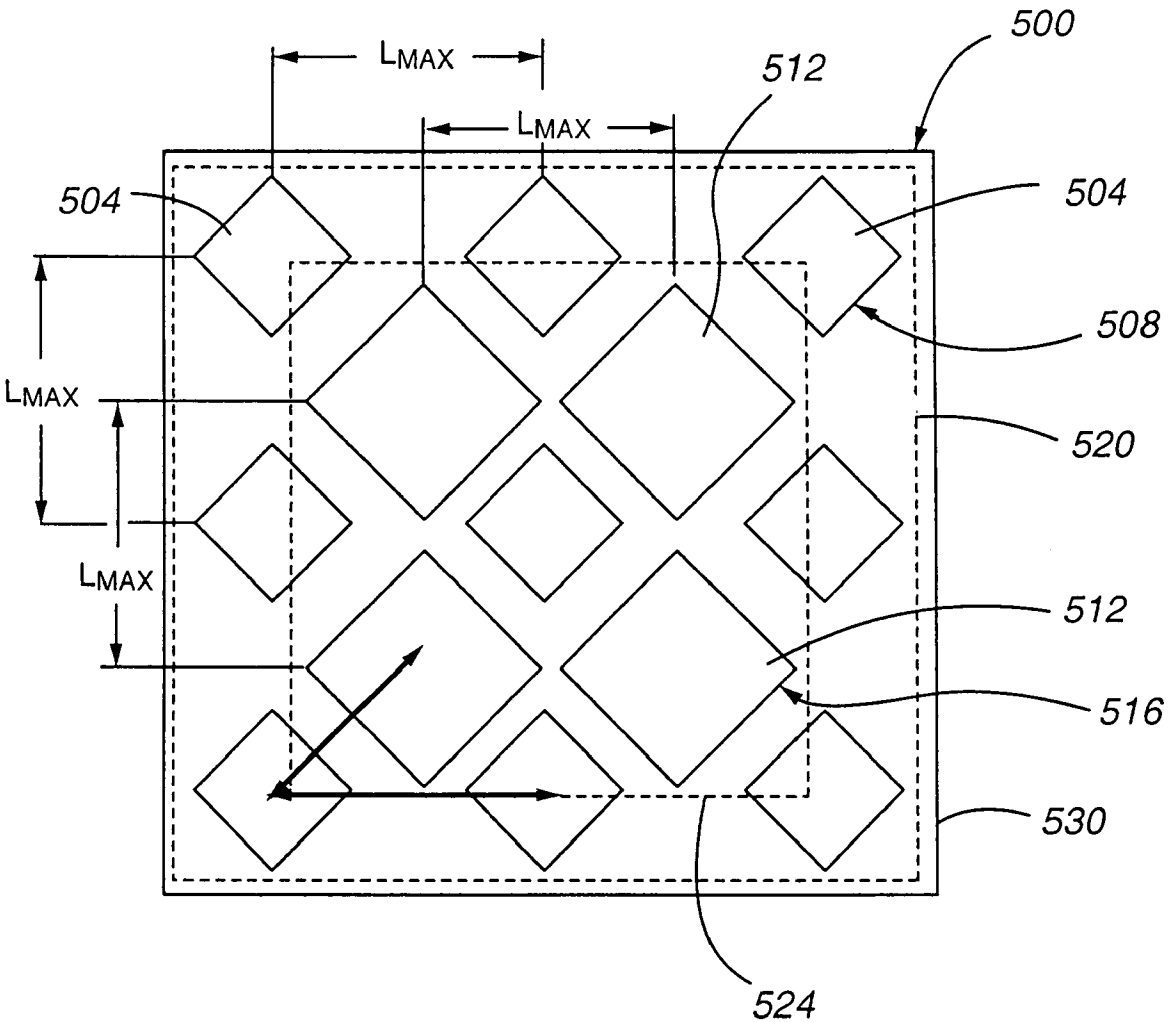
FIG. 5 is a plan view of a dual band array antenna having rectangular radiator elements in accordance with an embodiment of the present invention.

With reference now to FIG. 5, a dual band antenna 500 in accordance with still another embodiment of the present invention is illustrated. In general, the antenna 500 includes a first plurality of radiator elements 504, forming a first array 508 for operating at a first operating or center frequency $f_1$. In addition, a second plurality of radiator elements 512 are provided, forming a second array 516 for operating at a second operating or center frequency $f_2$. Each of the elements 504, 512 of the first 508 and second 516 arrays are arranged about rectangular lattices and have a center to center spacing with respect to other elements of their respective array equal to $L_{max}$.

The elements 504, 512 of the dual band antenna 500 illustrated in FIG. 5 are square in outline. In addition, the sides of the radiator elements 504, 512 are angled with respect to the sides of the rectangular lattice about which the radiator elements 504, 512 are positioned. The first array 508 is formed from nine radiator elements 504 occupying a first area denoted by dotted line 520. The second array 516 includes four radiator elements 512 occupying a second area denoted by dotted line 524. From FIG. 5, it can be appreciated that the first area 520 includes all of the second area of 524. Furthermore, it can be appreciated that the second array 516 is centered with respect to the first array 508. Accordingly, the first 508 and second 516 arrays of the antenna 500 have co-located phase centers. The first 508 and 516 arrays may be formed on a substrate assembly 530 that provides a first dielectric constant with respect to the first plurality of radiator elements 508, a second dielectric constant with respect to the second plurality of radiator elements 512, and a common ground plane.

Figure 6:
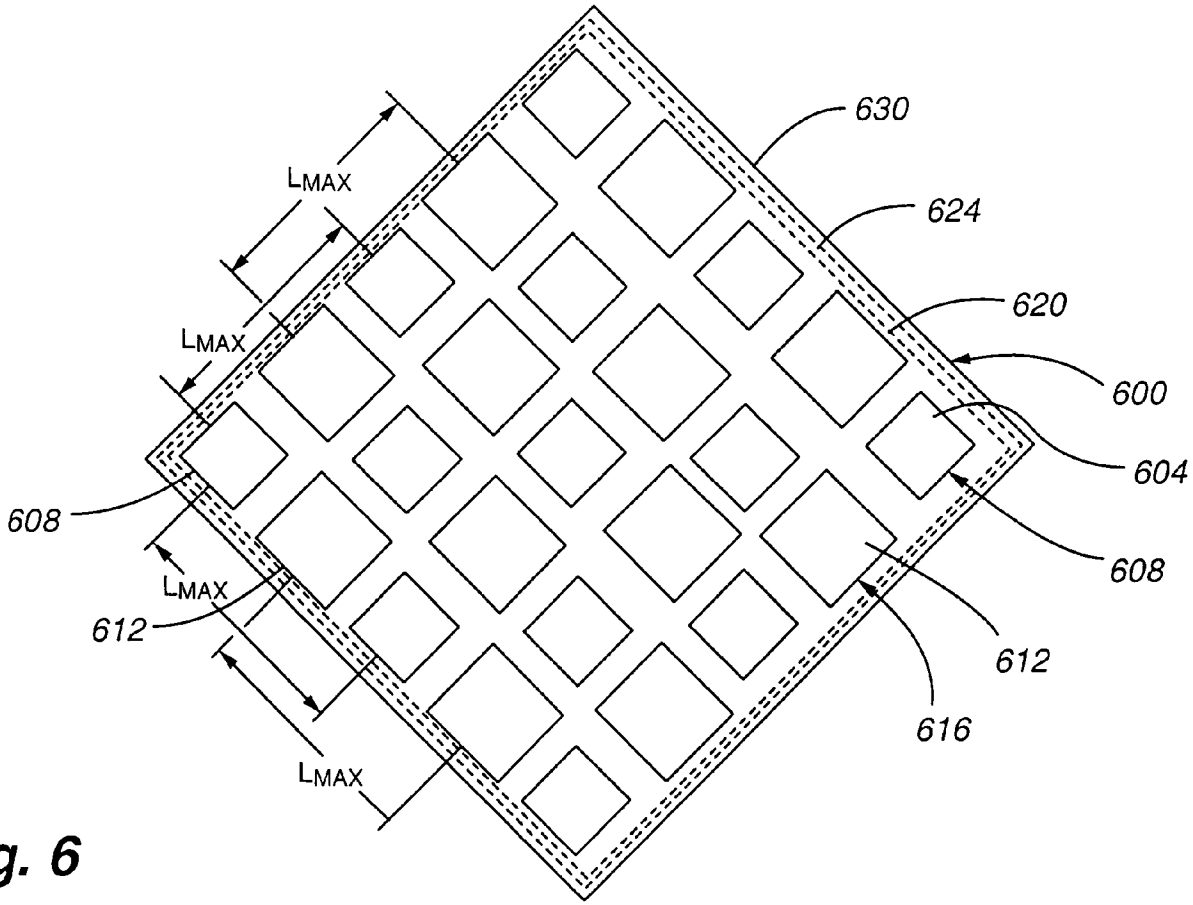
FIG. 6 is a plan view of a dual band array antenna having rectangular radiator elements in accordance with another embodiment of the present invention.

In FIG. 6, a dual band antenna 600 in accordance with still another embodiment of the present invention is illustrated. In general, the antenna 600 includes a first plurality of square radiator elements 604, forming a first array 608 for operation at a first operating or center frequency $f_1$. The antenna 600 additionally includes a second plurality of square radiator elements 612 forming a second array 616 for operation at a second operating or center frequency $f_2$. The radiator elements 604 of the first array 608 are arranged about a rectangular lattice and are spaced from one another by a distance equal to $L_{max}$. Similarly, the second radiator elements 612 are spaced about a rectangular lattice and have a center to center distance from one another that is also equal to $L_{max}$. The elements 604 of the first array 608 are interlaced with the elements 612 of the second array 616 to minimize the surface area occupied by the antenna 600. In particular, in FIG. 6 it is apparent that the area occupied by the first array 608, denoted by dotted line 620, is essentially the same as the area occupied by the second array 616, denoted by dotted line 624. Furthermore, it can appreciated that the areas 620, 624 share a common center point, allowing the first 608 and second 616 arrays to share a common phase center. The arrays 608, 616 may be formed on a common substrate assembly 630 providing appropriate dielectric constants, over a common ground plane.

Figure 7:
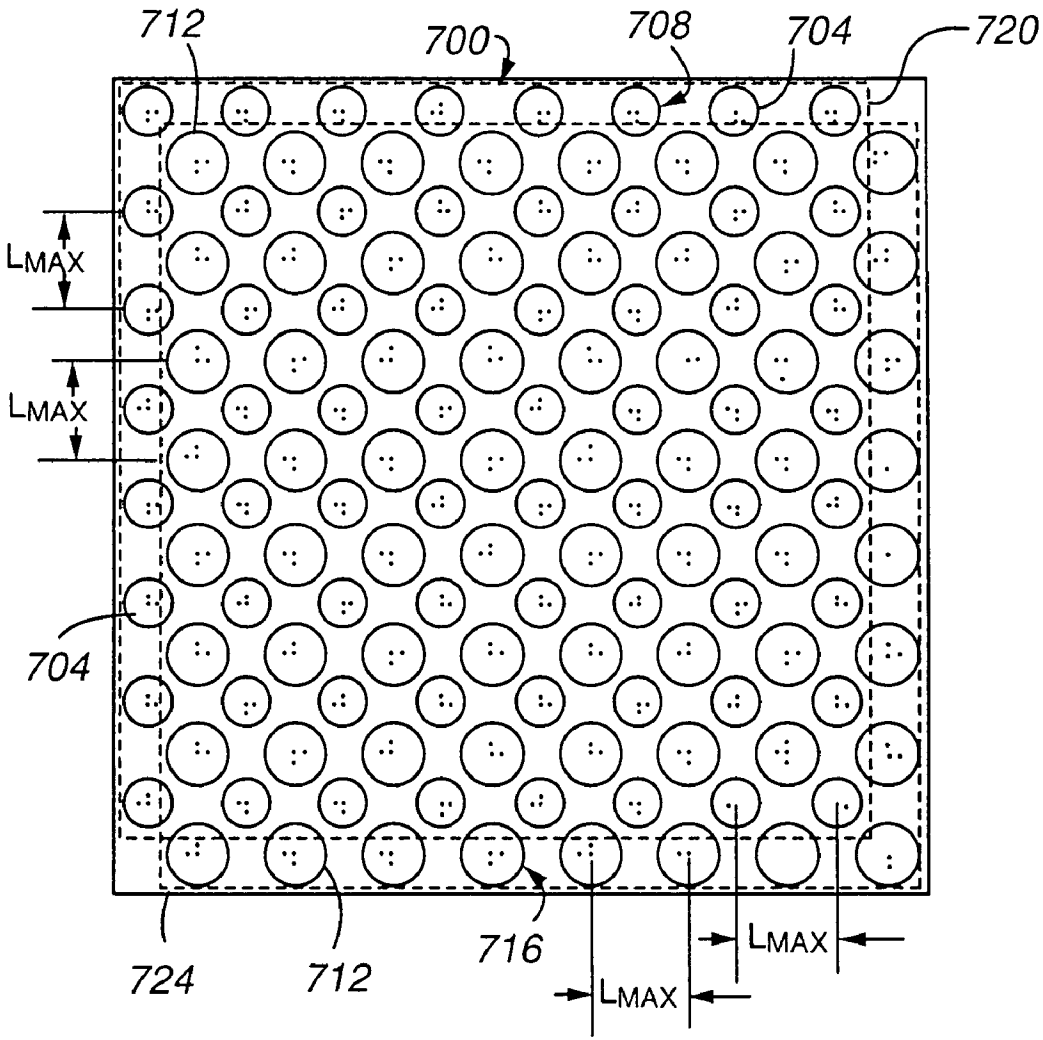
FIG. 7 is a plan view of a dual band array antenna having circular radiator elements in accordance with yet another embodiment of the present invention.

With reference now to FIG. 7, a dual band antenna 700 in accordance with still another embodiment of the present invention is illustrated. In general, the dual band antenna 700 comprises a first plurality of radiator elements 704 forming a first array 708 for operation at a first operating or center frequency $f_1$. In addition, the antenna 700 comprises a second plurality of radiator elements 712 forming a second array 716 for operation at a second operating or center frequency $f_2$. As in the embodiments illustrated in FIGS. 1 and 3, the radiator elements 704, 712 of the dual band antenna 700 are circular. The radiator elements 704 of the first array 708 are arranged about a rectangular lattice and have a center to center spacing equal to $L_{max}$. Similarly, the radiator elements 712 of the second array 716 are arranged about a rectangular lattice and have a center to center spacing equal to $L_{max}$.

In the embodiment illustrated in FIG. 7, each of the arrays 708, 716 comprises 64 radiator elements 704, 712. The radiator elements 704 comprising the first array 708 generally occupy an area denoted by dotted line 720. The radiator elements 712 comprising the second array 716 generally occupy a second area denoted by dotted line 724. The first 720 and second 724 areas substantially overlap. The arrays 708, 716 may be formed on a substrate assembly 730 that provides a first dielectric constant ($e_{r1}$) with respect to the radiator elements 704 of the first array 708, a second dielectric constant ($e_{r2}$) with respect to the radiator elements 712 of the second array 716, and a common ground plane.

Figure 8:
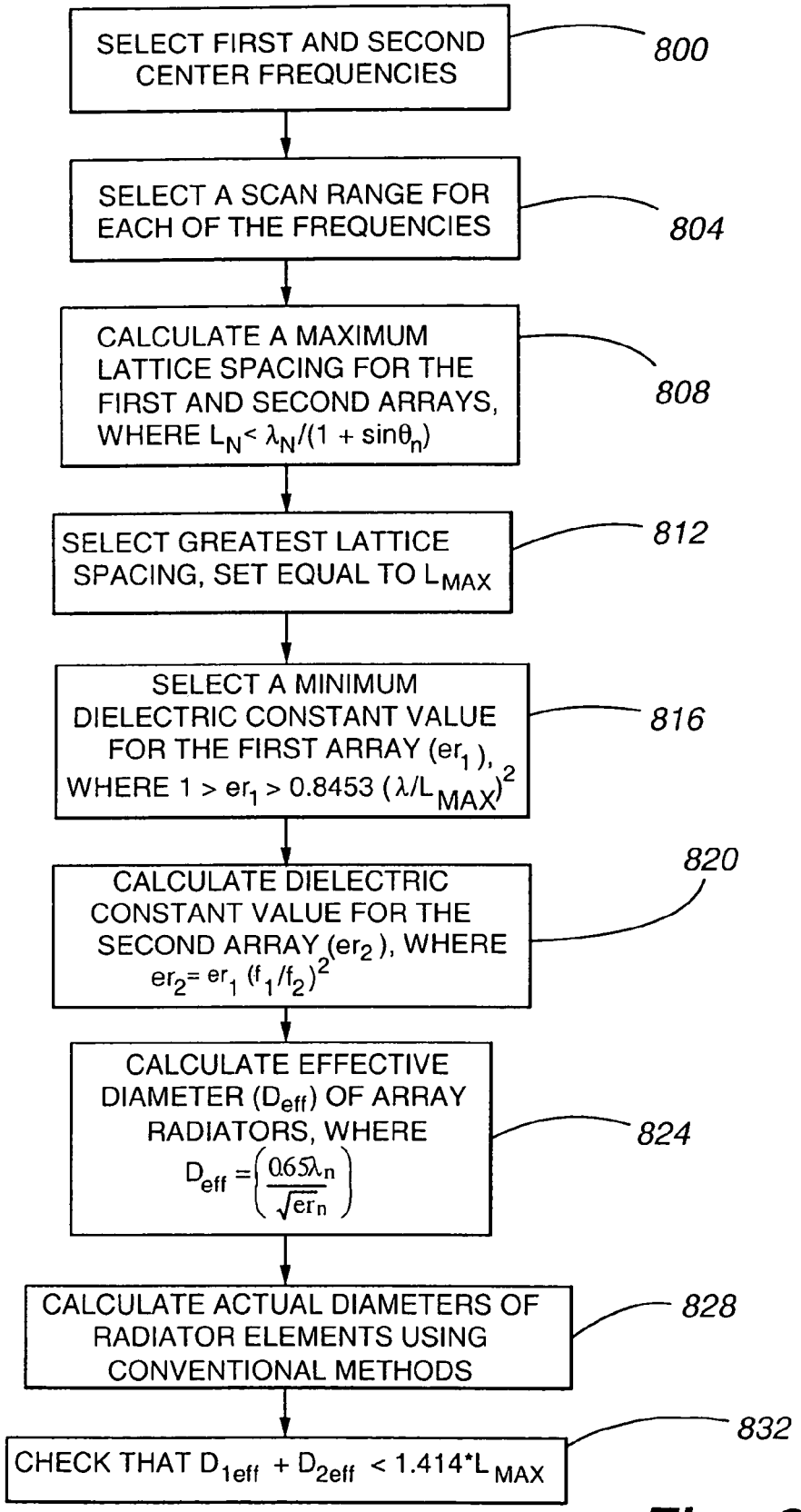
FIG. 8 is a flow chart illustrating a method of dimensioning a dual band array antenna in accordance with an embodiment of the present invention.

With reference now to FIG. 8, a flow chart illustrating a method of dimensioning a dual band array antenna in accordance with an embodiment of the present invention is shown. Initially, at step 800, the first ($f_1$) and second ($f_2$) center or operating frequencies of the dual band antenna are selected. In general, the first and second center frequencies will be determined by the system in connection with which the antenna is to be used. For example, in a global positioning system (GPS) application, an antenna for use on a GPS satellite may have a first center frequency of 1,575 Megahertz and a second center frequency of 1,227 Megahertz. Next, a scan range for each of the center frequencies is selected (step 804). Continuing the example of a GPS satellite application, the first and second center frequencies may both have a scan range of 14°.

From the selected frequency and scan range parameters, a maximum lattice spacing for the first and second arrays that will comprise the dual band antenna are calculated (step 808). In particular, the maximum lattice spacing for the first array ($L_1$) is given by $L_1<\lambda_1/(1+\sin(\theta_1))$, where $\lambda_1$ is the wavelength of the carrier signal at the first center frequency, and where $\theta_1$ is the scan range for the signal at the first center frequency. Similarly, the maximum lattice spacing for the second array ($L_2$) is given by $L_2<\lambda_2/(1+\sin(\theta_2))$, where $\lambda_2$ is the wavelength of the carrier signal at the second center frequency, and where $\theta_2$ is the scan range for the signal at the second center frequency. The maximum lattice spacing ($L_{max}$) is the largest spacing value that satisfies both the requirements for $L_1$ and the requirements for $L_2$ (Step 812).

A minimum dielectric constant value ($e_{r1}$) for a first substrate adjacent the radiator elements of the first array is then selected. The value for $e_{r1}$ is given by the following: $e_{r1}>0.8453\ (\lambda_1/L_{max})^2$, where $e_{r1}$ is also no less than 1.0. (Step 816). Once the minimum dielectric constant value for the first array has been calculated, the dielectric constant value ($e_{r2}$) for a second substrate adjacent the radiator elements of the second array can be calculated from the equation $e_{r2}=e_{r1}*(f_1/f_2)^2$ (Step 820). Next, the effective diameter (D) of the radiator elements can be calculated from the equation $$Dneff = \left(\frac{0.65\lambda_n}{\sqrt{e_m}}\right)$$

(Step 824). Then, the actual diameters of the radiator elements may be calculated using conventional methods (step 828). A check may then be made to ensure that the effective diameters of the interlaced radiator elements will not encroach on one another at the selected lattice spacing $L_{MAX}$ (i.e. that $D_{1eff}+D_{2eff}<1.414*L$ for a square lattice) (Step 832). If the effective diameters of adjacent radiator elements do encroach on one another, a greater dielectric constant value ($e_{r1}$) for the first substrate may be selected, and a new dielectric constant value ($e_{r2}$) for the second substrate may be calculated. The effective diameters of the radiator elements may then be recalculated, and a check may again be made to ensure that the effective diameters of the radiator elements do not encroach on one another.

As can be appreciated by one of ordinary skill in the art, a phased array antenna may be scanned in two dimensions. For antennas in which the scan range for both arrays is the same in both dimensions, the value obtained for $L_{max}$ is also the same in both dimensions. Furthermore, it can be appreciated that the rectangular lattice spacing obtained for the radiator elements results in a square lattice when the scan ranges in two dimensions are the same.

If different scan ranges are desired for the two dimensions, separate calculations are made for the element spacing in each of the two dimensions. That is a maximum element spacing for the first array in the x dimension $L_{1x}$, a maximum element spacing for the first array in the y dimension $L_{1y}$, a maximum element spacing for the second array in the x dimension $L_{2x}$, and a maximum element spacing for the second array in y dimension $L_{2y}$ are calculated. The smaller of the $L_{1x}$ and $L_{2x}$ is then selected as $L_{maxx}$ (i.e. the maximum lattice spacing the x dimension), and the smaller of $L_{1y}$ and $L_{2y}$ is selected as $L_{maxy}$(i.e. the maximum lattice spacing in y dimension). As can be appreciated, an antenna in accordance with the present invention having different scan ranges in two dimensions may therefore have a rectangular lattice spacing that is not square.

As can also be appreciated, the scan ranges for the first and second array need not be equal. Therefore, as many as four different scan ranges may be associated with an antenna in accordance with the present invention.

Where different lattice spacings are used for the x and y dimensions, a different check must be made to ensure that the effective diameters of the interlaced radiator elements will not encroach on one another. In particular, the inequality $$D_{1eff}+D_{2eff}<\sqrt{L_1^2+L_2^2}\ \textit{must be satisfied.}$$

The method disclosed herein for dimensioning a dual band array antenna allows radiator elements of the first and second arrays to be interlaced with one another to minimize the surface area occupied by the antenna. In addition, the disclosed method provides a dual band antenna with interlaced arrays with minimal or no grating lobes or losses, such as can occur when large distances separate radiator elements of an array. The disclosed method for dimensioning a dual band antenna also results in minimal coupling and losses at the operating frequencies that might otherwise be caused by the close proximity of the radiator elements of the two arrays. Furthermore, the electrical spacing between the radiator elements is optimized by providing proper dielectric loading of the radiator elements.

Figure 9:
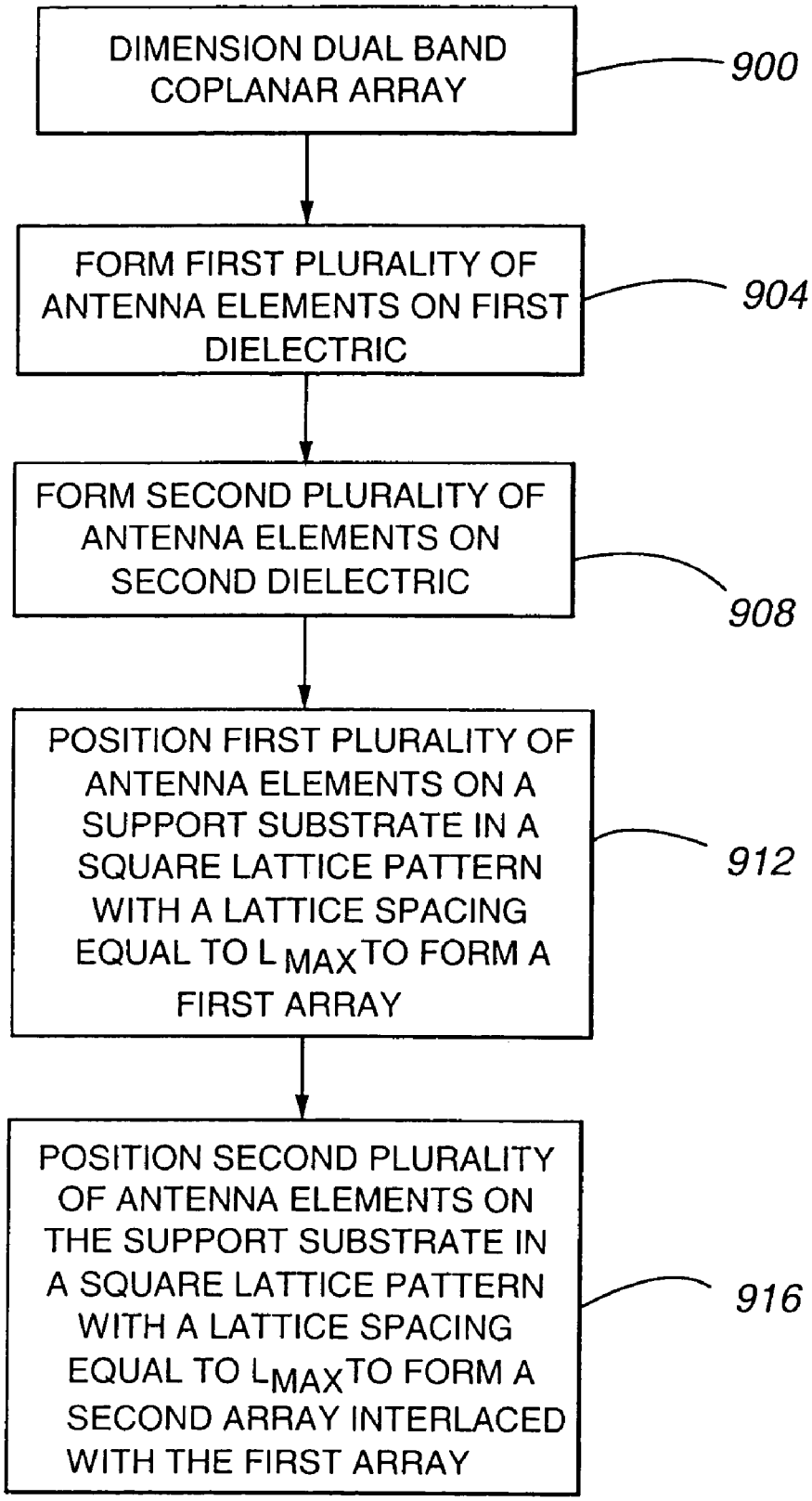
FIG. 9 is a flow chart illustrating the manufacture of a dual band array antenna in accordance with an embodiment of the present invention.
Figure 10A:
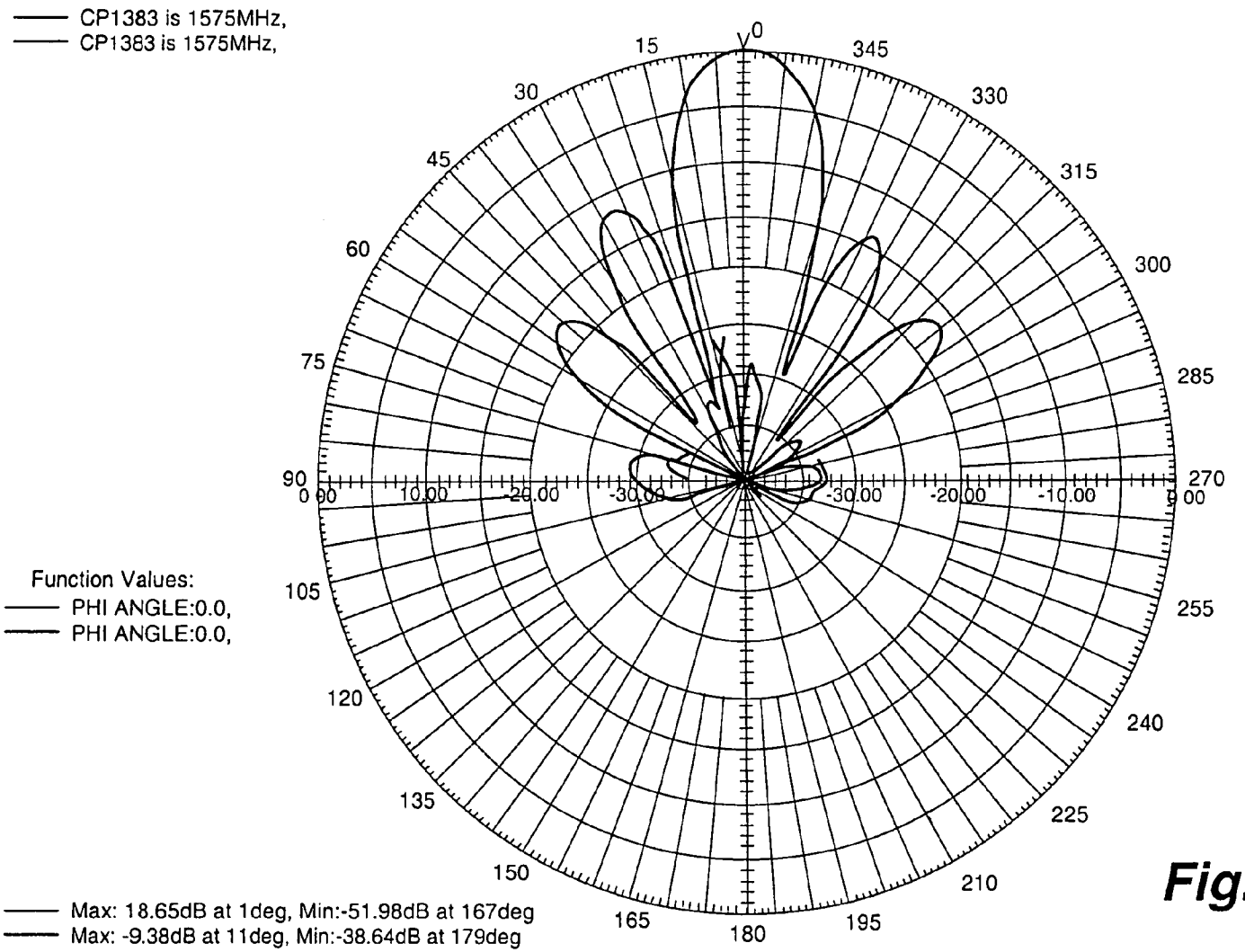
FIGS. 10A–10D illustrate radiation patterns produced by a first array of a dual band array antenna operating at a first frequency in accordance with an embodiment of the present invention.
Figure 10B:
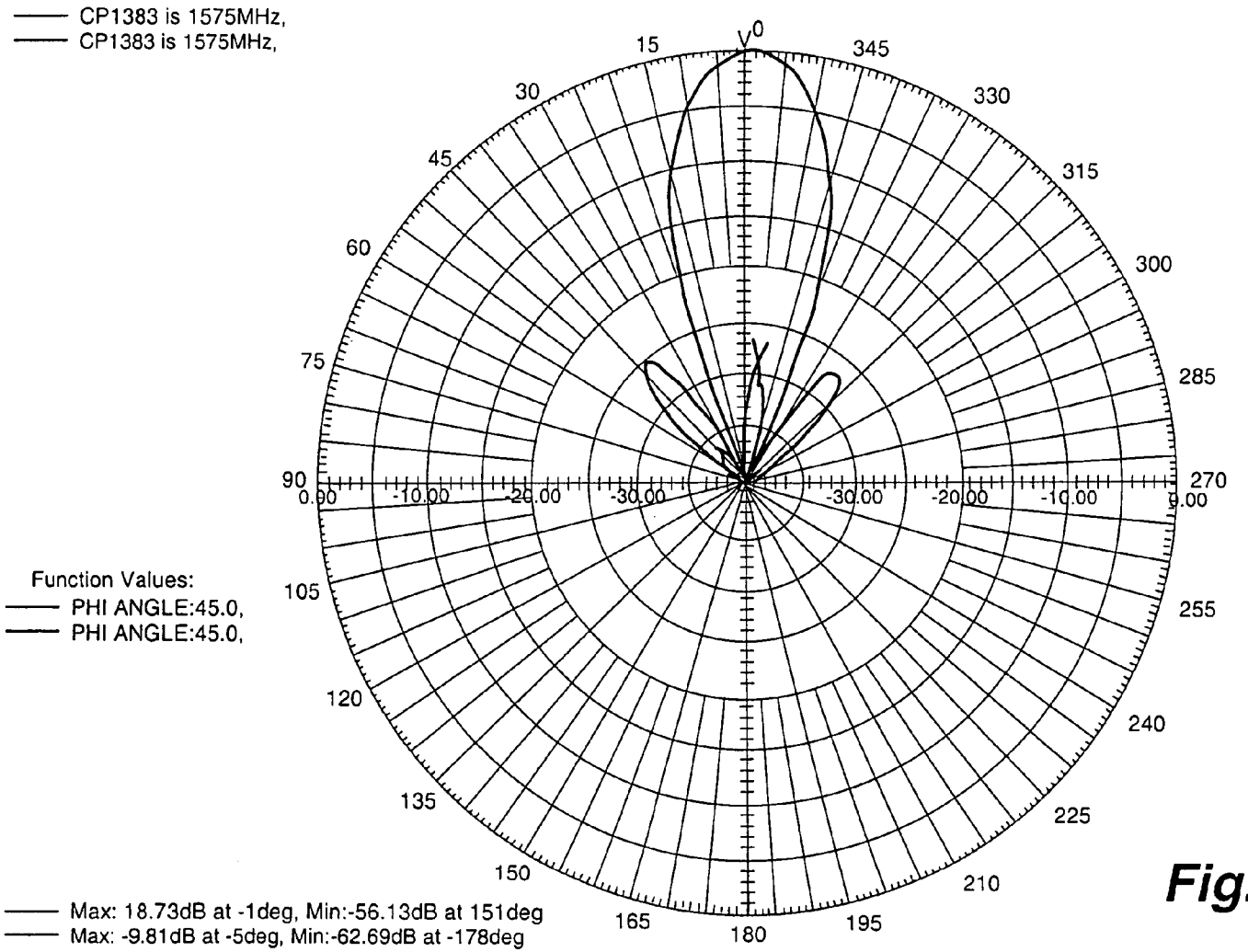
Figure 10C:
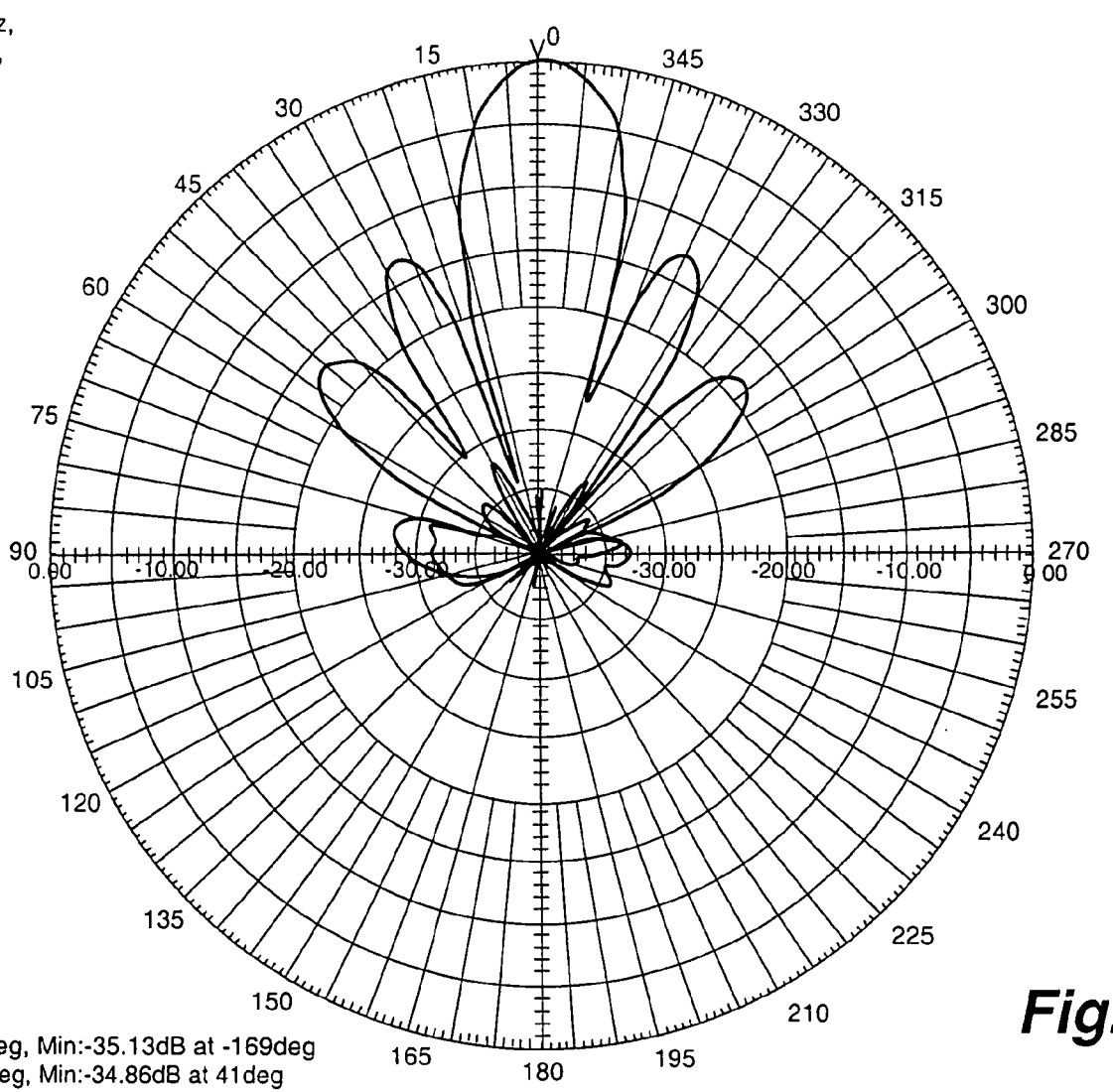
Figure 10D:
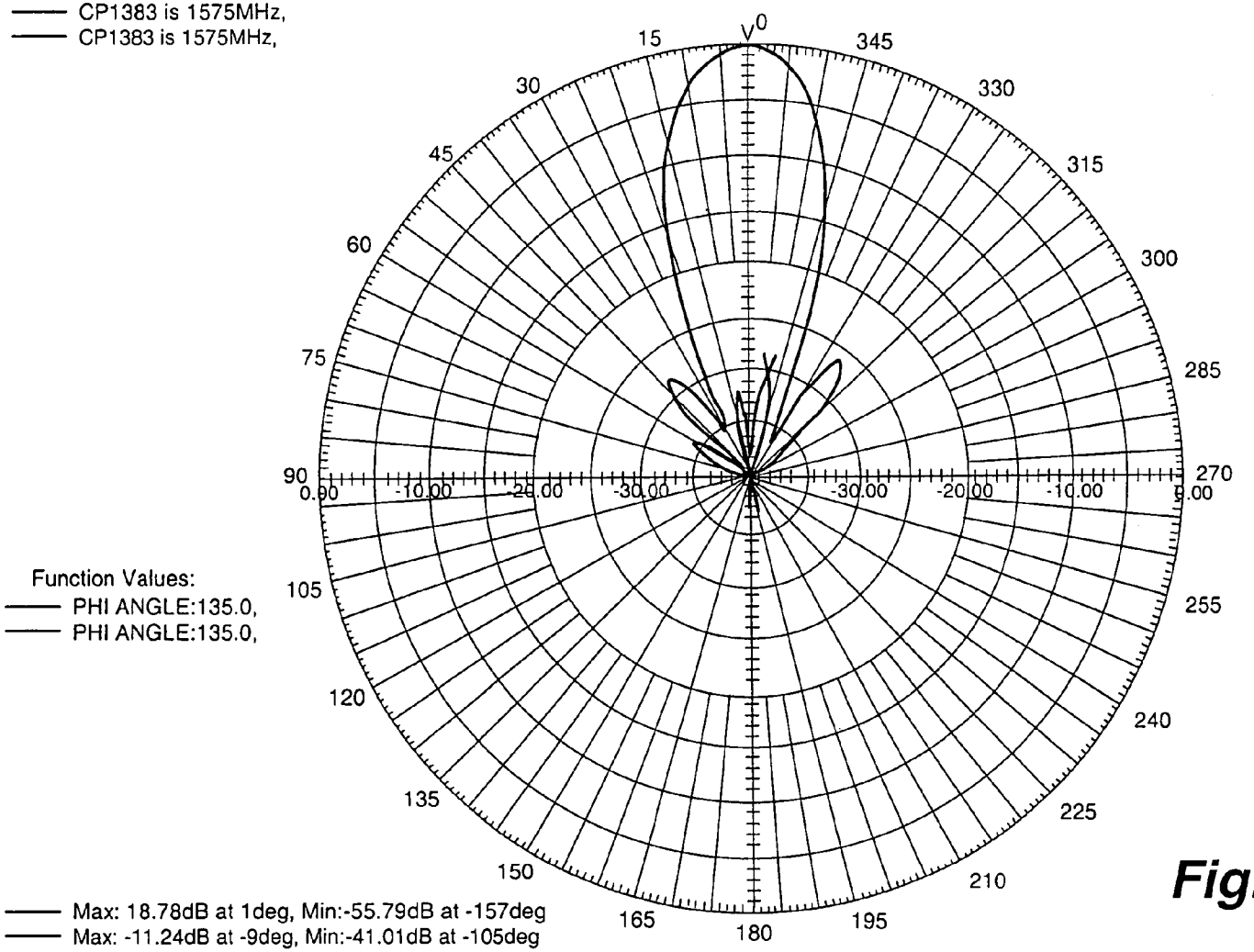
Figure 11A:
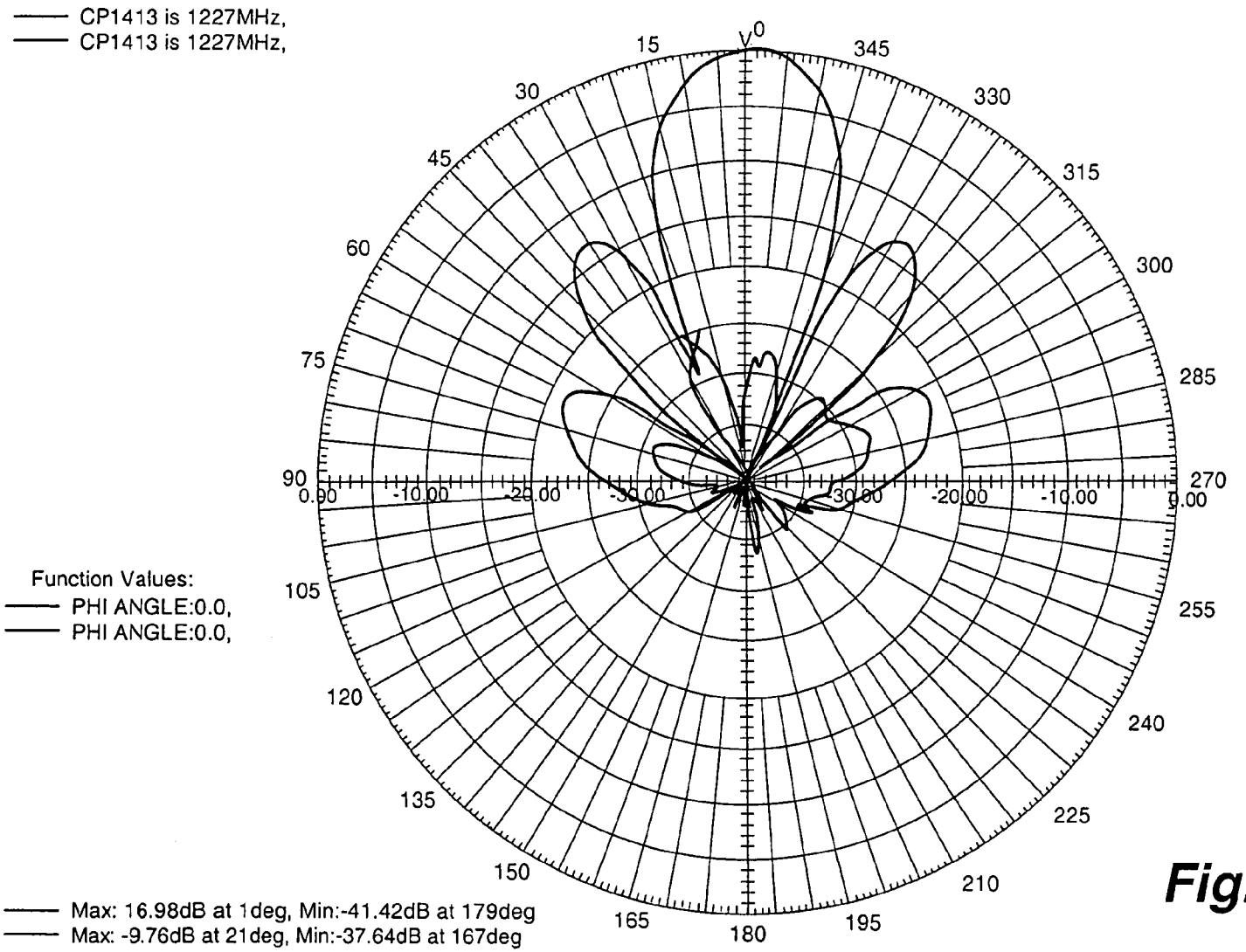
FIGS. 11A–11D illustrate radiation patterns produced by a second array of a dual band array antenna operating at a second frequency in accordance with an embodiment of the present invention.
Figure 11B:
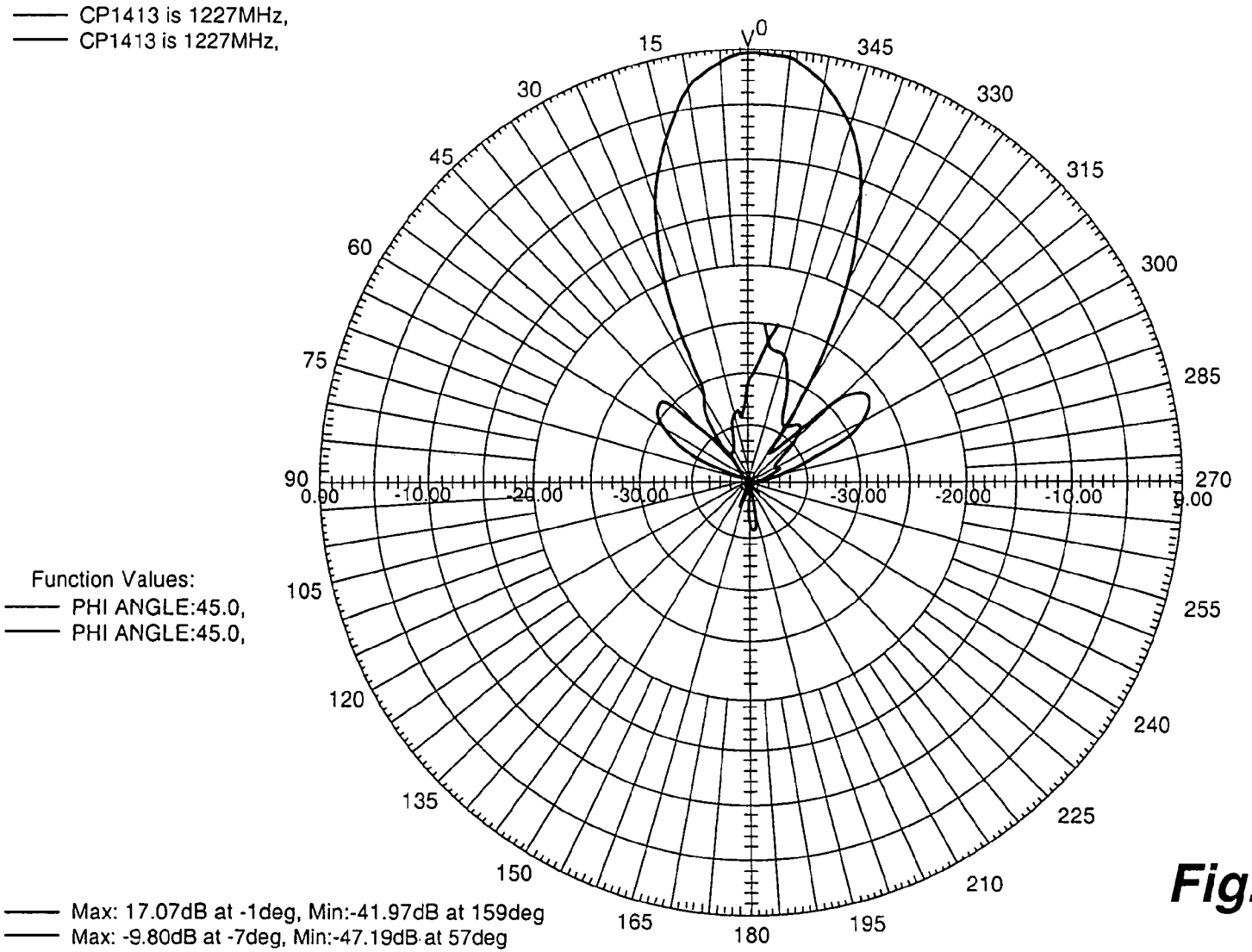
Figure 11C:
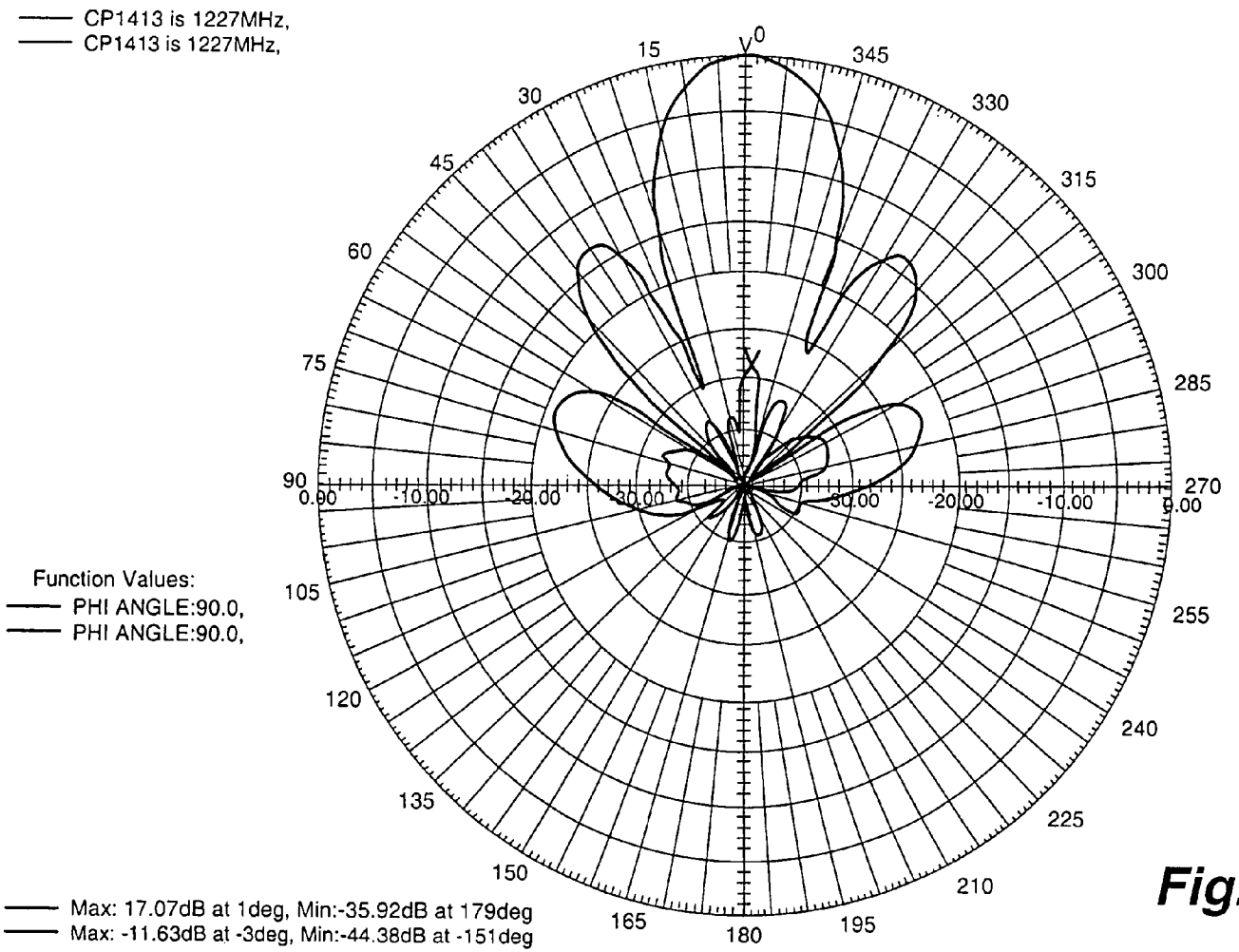
Figure 11D:
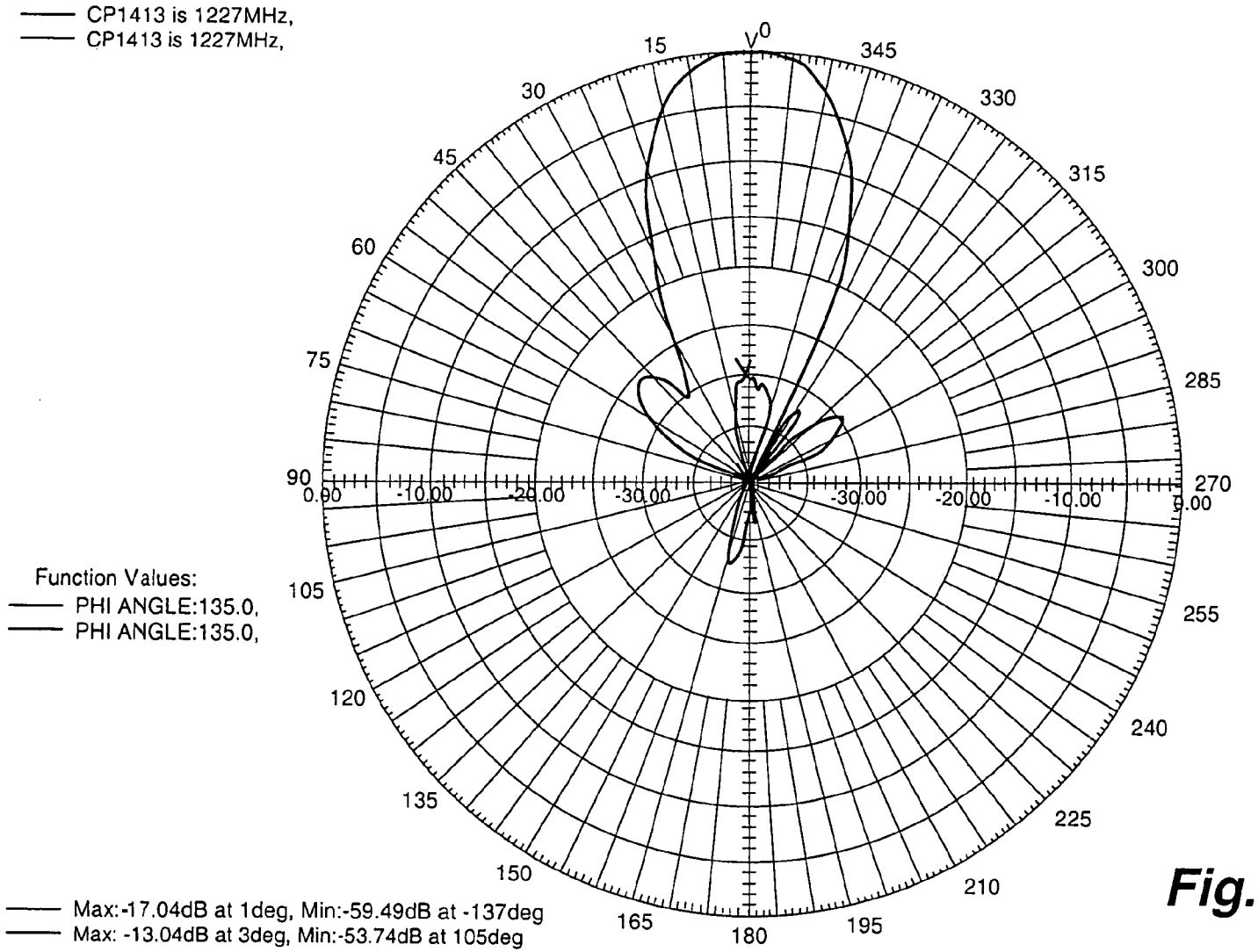

With reference now to FIG. 9, a flow chart illustrating the manufacture of a dual band array antenna in accordance with an embodiment of the present invention is illustrated. Initially, at step 900, the dual band co-planar antenna is dimensioned as described above in connection with FIG. 8. Next, a first plurality of antenna elements is formed on a first dielectric (step 904). A second plurality of antenna elements is then formed on a second dielectric material 908. At step 912, the first plurality of antenna elements is positioned on a ground plane in a rectangular lattice pattern, with a lattice spacing equal to $L_{max}$ to form a first array. At step 916, the second plurality of antenna elements is positioned on the ground plane in a rectangular lattice pattern with a lattice spacing equal to $L_{max}$ to form a second array interlaced with the first array.

As an example of the dimensioning of a phased array antenna in accordance with an embodiment of the invention, the selected first center or operating frequency ($f_1$) may be equal to 1,575 megahertz, and the second operating or center frequency ($f_2$) may be equal to 1,227 megahertz. The selected scan ranges for both frequencies may be 14 degrees. Initially, $L_{MAX}$ is calculated from $L_n<\lambda_n/(1+\sin(\theta_n))$ to equal 15.337 cm. Next, a first dielectric constant value ($e_{r1}$) that satisfies the inequality $e_{r1}>0.8453\ (\lambda_1/L_{max})^2$ and that is no less than 1.0 is chosen. According to the present example, a value of $e_{r1}=1.3038$ is selected. Next, a second dielectric constant value ($e_{r2}$) is calculated as follows: $e_{r2}=e_{r1}(f_1/f_2)^2=2.1482$. The effective diameter $D_{neff}$ is then calculated from $$Dneff = \left(\frac{0.65\lambda_n}{\sqrt{e_m}}\right)$$

j to be 10.843 cm. Finally, using circular radiator elements, the radiator elements of the first array are calculated to have a diameter of 8.7 cm, and the radiator elements of the second array are calculated to have a diameter of 9.2 cm. According to this example, both arrays have an equal scan range in each dimension. Therefore, only one value for $L_{max}$ is calculated, and the elements of the arrays are arranged about a square lattice.

In FIGS. 10A–10D, the radiation pattern produced by a first array of antenna elements included as part of an example dual band array antenna in accordance with the present invention in various planes ($\phi$=0, 45, 90 and 135 degrees) through the antenna and for a first operating frequency are illustrated. In FIGS. 11A-11D, the radiation patterns produced by a second array of antenna elements included as part of the example dual band frequency antenna in various planes ($\phi$=0, 45, 90 and 135 degrees) through the antenna and for a second operating frequency are illustrated. The radiation patterns illustrated in FIGS. 10 and 11 are practically indistinguishable from the radiator patterns obtained from independent, non-interlaced arrays that provide similar operating characteristics. Therefore, it can be appreciated that the present invention provides dual band antenna characteristics using an antenna that occupies much less area than a conventional antenna utilizing two independent, non-interlaced arrays capable of providing comparable operating characteristics.

Figure 12:
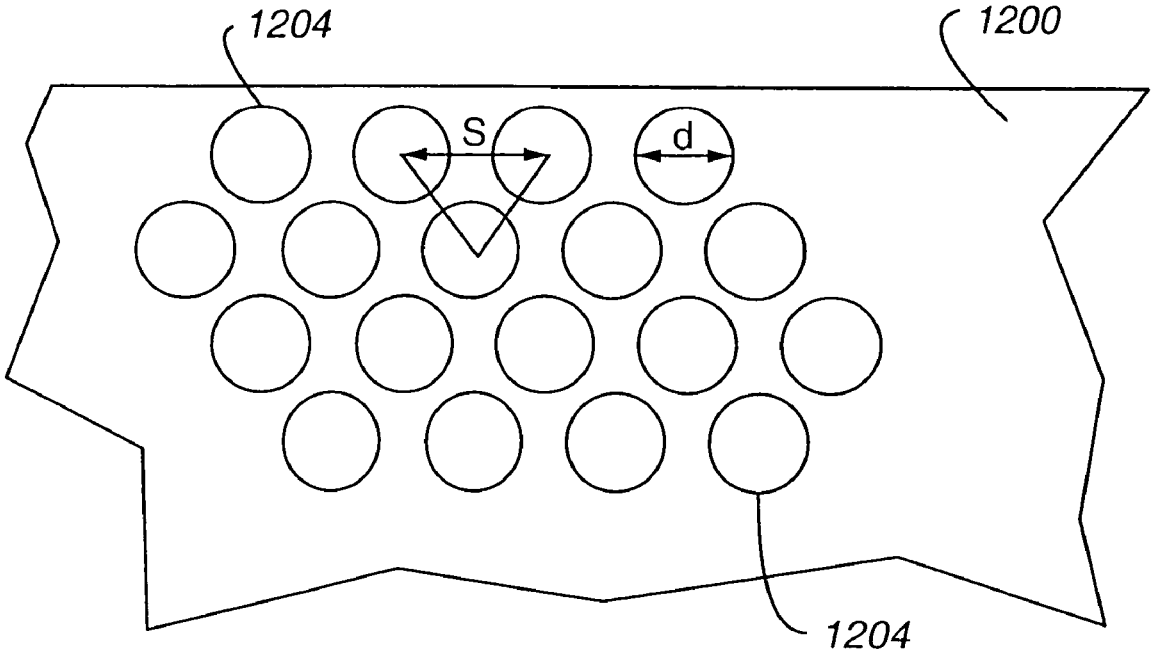
FIG. 12 is a schematic representation of a dielectric material having a modified dielectric constant in accordance with an embodiment of the present invention.

As can be appreciated by one of ordinary skill in the art, materials having certain dielectric constants may not be available, or may be difficult and expensive to obtain. In accordance with an embodiment of the present invention, the dielectric constant of a solid sheet of material 1200 may be lowered by drilling holes 1204 of appropriate diameter in a uniform, equilateral triangular pattern, as shown in FIG. 12. Using an equivalent static capacitance approach, the modified effective dielectric constant $e_m$ is given by the equation $e_m=e_r-0.25(e_r-1)\pi d^2/0.866S^2$, where $e_r$ is the dielectric constant of the solid material, S is the nearest neighbor spacing between the holes, and d is the diameter of the holes.

In general, when using this technique, S and d should be very small compared to the highest operating wavelength of the radiator elements used in connection with the dielectric material. For example, the inventors have found that acceptable results are obtained if S and d are both less than $\lambda/64$, where $\lambda$ is equal to the wavelength of the highest operating frequency of the antenna. In addition, S must be greater than d, since S-d represents the wall thickness between holes. Accordingly, in order to use this method, one starts with a hole diameter d that is less than $\lambda/64$, and then calculates the spacing S using the following equation, which can be readily derived from the equation given above for the modified dielectric constant:

$$S = 0.9523\ d\ \sqrt{\frac{(e_r - 1)}{(e_r - e_m)}}\ .$$

If the resulting wall thickness S-d is too small or is negative, the dielectric constant of the solid material cannot be lowered to the desired level without violating the condition that d be less than $\lambda/64$ using this approach.

As an example, the dielectric constant value $e_r$ of a typical substrate material is 2.33. According to the present example, it will be assumed that the desired modified effective dielectric constant $e_m$ is 1.5. The diameter of the holes will be selected to be d=0.0635 inch, which corresponds to a standard drill bit size, and which satisfies the inequality $d<\lambda/64$. Using the equation given above, we obtain a value of S=0.0764 inch. This corresponds to a wall thickness of 0.0129 inch.

If a lower modified effective dielectric constant were desired, for example, $e_m$=1.4, then a larger hole diameter, for example, 0.1 inch, could be used. According to this second example, S is equal to 0.1137, resulting in a wall thickness of 0.0137 inch. Using this configuration, S and d would continue to satisfy the requirement that they be less than $\lambda/64$ up to a frequency of 1,623 MHZ. Therefore, such a configuration could be used in connection with GPS frequencies, which are 1,227 MHZ and 1,575 MHZ. Furthermore, it should be noted that the requirement that S and d be less than $\lambda/64$ is a guideline, and can be exceeded in particular circumstances.

The disclosed technique for modifying the dielectric constant of a solid sheet of material is particularly suited for use in connection with dual frequency arrays with interleaved elements as described herein. The hole patterns in the dielectric substrates can be locally tailored to provide the desired dielectric constant required by the radiating elements operating at each frequency. Therefore, in accordance with the present invention, it can be appreciated that the first 120 and second 124 dielectric materials may be formed from a common dielectric material, with the effective dielectric constant of the material modified with respect to either or both of the first and/or second pluralities of radiator elements 104, 108. In addition, it should be appreciated that the dielectric materials 120, 124 can be formed from a single sheet or piece of dielectric material that is modified in areas adjacent to the first plurality of radiator elements 104 using a first diameter and spacing of holes, and is modified in areas adjacent the second plurality of radiator elements 108 using a second diameter and spacing between holes.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention, and to enable others skilled in the art to utilize the invention in such and in other embodiments and with various modifications required by their particular application or use of the invention. It is intended that the appended claims be construed to include alternative embodiments to the extent permitted by the prior art.

What is claimed is:

1. An antenna apparatus, comprising:

a dielectric material having at least a first relieved portion, wherein a dielectric constant of said dielectric material is modified in an area of said at least a first relieved portion, wherein said at least a first relieved portion defines a volume that does not contain a conductive material; and at least a first radiator element interconnected to said dielectric material.

2. The apparatus of claim 1, wherein said at least a first radiator element is on a first side of said dielectric material, said antenna further comprising a ground plane on a second side of said dielectric material.

3. The apparatus of claim 1, wherein said at least a first relieved portion of said dielectric material comprises a hole.

4. The apparatus of claim 1, wherein said at least a first relieved portion of said dielectric material comprises a plurality of holes, wherein said at least a first radiator element passes across an end of at least one of said holes, and wherein said holes do not contain a conductive material.

5. The apparatus of claim 4, wherein said plurality of holes are arranged in a triangular pattern.

6. The apparatus of claim 4, wherein said plurality of holes are arranged in an equilateral triangular pattern.

7. The apparatus of claim 1, wherein said dielectric material comprises a sheet of dielectric material.

8. The apparatus of claim 1, further comprising a plurality of antenna elements interconnected to at least a first surface of said dielectric material.

9. The apparatus of claim 1, further comprising:

a first plurality of antenna elements comprising a first array on a first surface of said dielectric material, said first plurality of antenna elements including said first radiator element; and a second plurality of antenna elements comprising a second array on said first surface of said dielectric material and interlaced with said first plurality of antenna elements.

10. The apparatus of claim 9, wherein said dielectric material is relieved in areas corresponding to said first plurality of antenna elements, wherein a first dielectric constant is presented to said first plurality of antenna elements, and wherein a second dielectric constant is presented to said second plurality of antenna elements.

11. The apparatus of claim 10, wherein said dielectric material is not relieved in areas corresponding to said second plurality of antenna elements.

12. The apparatus of claim 10, wherein said first and second arrays are arranged about first and second rectangular lattices having a first lattice spacing.

13. The apparatus of claim 12, wherein said first array has a first frequency of operation ($f_1$), wherein said second array has a second frequency of operation ($f_2$), wherein said first dielectric constant is equal to $er_1$, and wherein said second dielectric constant ($e_{r2}$) is given by the expression $e_{r2}=e_{r1}*(f_1/f_2)^2$.

14. The apparatus of claim 9, wherein an area occupied by said first array substantially overlaps an area occupied by said second array.

15. The apparatus of claim 9, further comprising a plurality of signal amplifiers, wherein at least one amplifier is associated with each radiator element of said first and second arrays.

16. An antenna apparatus, comprising:

a dielectric material having at least a first relieved portion, wherein a dielectric constant of said dielectric material is modified in an area of said at least a first relieved portion;

at least a first radiator element interconnected to said dielectric material wherein said dielectric constant of said dielectric material in an area of said at least a first relieved portion is equal to $e_m$, wherein $e_m=e_r-0.25(e_r-1)\pi d^2/0.866S^2$, where $e_r$ is the dielectric constant of said dielectric material without modification, where S is a center to center spacing between said holes, and where d is a diameter of said holes.

17. An antenna apparatus, comprising:

a dielectric material having at least a first relieved portion, wherein a dielectric constant of said dielectric material is modified in an area of said at least a first relieved portion;

at least a first radiator element interconnected to said dielectric material;

wherein said at least a first relieved portion of said dielectric material comprises a plurality of holes;

wherein said plurality of holes are arranged in a triangular pattern; and wherein said plurality of holes have a diameter d and a center to center hole spacing S, and wherein $d<\lambda/64$ and $S<\lambda/64$, where $\lambda$ is equal to a wavelength of a highest operating frequency of said antenna.

18. The apparatus of claim 17, wherein S is greater than d.

19. An antenna apparatus, comprising:

a dielectric material having at least a first relieved portion, wherein a dielectric constant of said dielectric material is modified in an area of said at least a first relieved portion;

at least a first radiator element interconnected to said dielectric material;

wherein said at least a first relieved portion of said dielectric material comprises a plurality of holes;

wherein said plurality of holes are arranged in a triangular pattern; and wherein said unmodified dielectric constant of said dielectric material is equal to $e_r$, and wherein $$S = 0.9523\, d \sqrt{\frac{(e_r - 1)}{(e_r - e_m)}},$$

where $e_m$ is a modified dielectric constant of said dielectric material, where S is a center to center spacing between holes, and where d is a diameter of the holes.

20. An antenna apparatus, comprising:

means for radiating at least a first radio frequency;

means for providing at least a first dielectric constant adjacent said means for radiating at least a first radio frequency, wherein at least a portion of said means for providing at least a first dielectric constant includes a relieved portion at a first location adjacent said means for radiating at least a first radio frequency; and means for providing a ground plane on a side of said means for providing at least a first dielectric constant opposite said means for radiating, wherein said means for radiating and said means for providing a ground plane are not electrically interconnected to one another by an electrically conductive material passing through said means for providing at least a first dielectric constant at said first location.

21. The apparatus of claim 20, further comprising:

means for radiating at least a second radio frequency; and means for providing at least a second dielectric constant adjacent said means for radiating at least a second radio frequency.

22. The apparatus of claim 21, wherein said means for providing at least a first dielectric constant is integral with said means for providing at least a second dielectric constant.

23. An antenna apparatus, comprising:

means for radiating at least a first radio frequency;

means for providing at least a first dielectric constant, wherein said means for radiating at least a first radio frequency is adjacent a first side of said means for providing a dielectric constant, wherein at least a portion of said means for providing at least a first dielectric constant is relieved adjacent said means for radiating at least a first radio frequency:

means for providing a ground plane on a second side of said means for providing at least a first dielectric constant;

means for radiating at least a second radio frequency; and means for providing at least a second dielectric constant adjacent said means for radiating at least a second radio frequency;

wherein at least a portion of said means for providing at least a second dielectric constant is relieved adjacent said means for radiating at least a second radio frequency.

24. A method for providing an antenna component, comprising:

selecting a first radio frequency having a first wavelength ($\lambda_1$);

selecting a material having a dielectric constant ($e_r$) that is greater than at least a first desired dielectric constant;

selecting a first hole diameter ($d_1$) that is less than the first wavelength ($\lambda_1$); and forming a number of holes of the first selected diameter ($d_1$) in the selected material to obtain a modified dielectric constant ($e_{m1}$) that is less than the dielectric constant ($e_r$) of the selected material without the holes.

25. The method of claim 24, further comprising:

calculating a hole spacing ($S_1$), wherein $$S_1 = c * d_1 * \sqrt{\frac{(e_r - 1)}{(e_r - e_m)}}.$$

26. The method of claim 25, wherein c is a constant having a value less than one.

27. The method of claim 25, wherein c has a value equal to about 0.9523.

28. The method of claim 25, wherein the hole spacing ($S_1$) is a center to center spacing of adjacent holes.

29. The method of claim 24, wherein the selected first hole diameter ($d_1$) is less than $\lambda_1/64$.

30. The method of claim 25, wherein the holes are located such that they have a center to center hole spacing ($S_1$) that is less than $\lambda_1/64$.

31. The method of claim 24, wherein the holes are arranged in an equilateral triangular pattern in the selected material.

32. The method of claim 24, wherein the holes having the first selected diameter ($d_1$) are formed in at least a first area of the selected material, wherein holes are not formed in at least a second area of the selected material, said method further comprising:

selecting a second radio frequency having a second wavelength ($\lambda_2$); and selecting a second desired dielectric constant, wherein the dielectric constant of the material ($e_r$) is equal to the second desired dielectric constant.

33. The method of claim 24, wherein the holes having the first selected diameter ($d_1$) are formed in at least a first area of the selected material, the method further comprising:

selecting a second radio frequency having a second wavelength ($\lambda_2$);

selecting a second hole diameter ($d_2$) that is less than the second wavelength ($\lambda_2$);

calculating a dielectric constant for the second plurality of radiator elements, wherein the second substrate dielectric constant comprises a function of the modified dielectric constant, the first center frequency, and the second center frequency;

calculating an effective size of the radiator elements included in the first plurality of radiator elements and the radiator elements included in the second plurality of radiator elements, wherein the effective size comprises a function of a wavelength of a one of the first and second frequencies and a corresponding one of the first and second substrate dielectric constants;

calculating a physical size of the radiator elements included in the first plurality of radiator elements; and calculating a physical size of the radiator elements included in the second plurality of radiator elements.

34. The method of claim 33, wherein the holes of the first selected diameter ($d_1$) and the holes of the second selected diameter ($d_2$) are formed in the same piece of the selected material.

35. The method of claim 24, further comprising:

selecting a second radio frequency having a second wavelength ($\lambda_2$);

selecting a desired scan range for the first radio frequency;

calculating a first lattice spacing between a first plurality of radiator elements associated with said first radio frequency, wherein said first lattice spacing comprises a function of the wavelength ($\lambda_1$) of said first radio frequency and the selected scan range of the first radio frequency;

selecting a desired scan range for the second radio frequency;

calculating a second lattice spacing between a second plurality of radiator elements associated with the second radio frequency, wherein the second lattice spacing comprises a function of the wavelength ($\lambda_2$) of the second radio frequency and the selected scan range of the second radio frequency;

determining a maximum lattice spacing, wherein the maximum lattice spacing is the smaller of the first and second lattice spacings, wherein the first plurality of radiator elements is arranged about a square lattice, wherein the first plurality of radiator elements have a center to center spacing equal to the maximum lattice spacing, wherein the second plurality of radiator elements is arranged about a square lattice, and wherein the second plurality of radiator elements have a center to center spacing equal to the maximum lattice spacing;

forming a number of the second selected diameter ($d_2$) in a piece of the selected material to obtain a second modified dieletric constant ($e_{m2}$) that is less than the dieletic constant ($e_r$) of the selected material without the holes, wherein the holes of the second selected diameter ($d_2$) are formed in at least a second area of the material.

36. An antenna apparatus comprising:

at least a first radiator element;

a dielectric material interconnected to the at least a first radiator element, said dielectric material including:

a first surface;

a second surface opposite and substantially parallel to said first surface; and at least a first relieved portion, wherein an electrically conductive material does not extend from a first one of said first and second surfaces to a second one of said first and second surfaces through the at least a first relieved portion.

* * * * *